US006933811B2

(12) United States Patent
Enokihara et al.

(10) Patent No.: US 6,933,811 B2
(45) Date of Patent: Aug. 23, 2005

(54) RESONATOR AND HIGH-FREQUENCY FILTER

(75) Inventors: Akira Enokihara, Nara (JP); Michio Okajima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 101 days.

(21) Appl. No.: 10/801,905

(22) Filed: Mar. 16, 2004

(65) Prior Publication Data

US 2004/0174234 A1 Sep. 9, 2004

Related U.S. Application Data

(63) Continuation of application No. 09/881,235, filed on Jun. 14, 2001, now Pat. No. 6,750,739.

(30) Foreign Application Priority Data

Jun. 15, 2000 (JP) ..... 2000-180401
Sep. 11, 2000 (JP) ..... 2000-274618

(51) Int. Cl.[7] ..... H01P 1/201; H01P 7/10
(52) U.S. Cl. ..... 333/202; 333/219.1
(58) Field of Search ..... 333/202, 219, 333/219.1, 230, 234

(56) References Cited

U.S. PATENT DOCUMENTS

| | | | | |
|---|---|---|---|---|
| 4,028,652 | A | 6/1977 | Wakino et al. | 333/209 |
| 4,639,699 | A | 1/1987 | Nishikawa et al. | 333/202 |
| 4,661,790 | A | 4/1987 | Gannon et al. | 333/234 |
| 4,725,798 | A | 2/1988 | Igarashi | 233/212 |
| 4,963,841 | A | 10/1990 | Sparagna | 333/202 |
| 5,805,033 | A | 9/1998 | Liang et al. | 333/202 |
| 5,874,870 | A | 2/1999 | Nishiyama et al. | 333/202 |
| 6,169,467 | B1 | 1/2001 | El-Sharawy | 333/219.1 |
| 6,255,917 | B1 | 7/2001 | Scott | 29/527.2 |
| 6,323,746 | B1 | 11/2001 | Prager et al. | 333/219.1 |

FOREIGN PATENT DOCUMENTS

| | | |
|---|---|---|
| EP | 0 859 423 A1 | 8/1988 |
| JP | 53-076747 A | 11/1976 |
| JP | 63-010603 A | 1/1988 |
| JP | 63-110618 | 5/1988 |
| JP | 63250201 | 10/1988 |
| JP | 63284902 | 11/1988 |
| JP | 08065006 A | 3/1996 |
| JP | 2000-114809 A | 4/2000 |

OTHER PUBLICATIONS

Farhat Abbas et al., "Ultra–high–Q resonators for low–noise, microwave signal generation using sapphire buffer layers and superconducting thin films"; Superconductor Science and Technology; vol. 7, No. 7; Jul. 1, 1994; pp. 495–501.

Notice of Reasons of Rejection for Patent Application No. 2001–176674 and English Translation; Mailed Sep. 24, 2003.

*Primary Examiner*—Robert Pascal
*Assistant Examiner*—Dean Takaoka
(74) *Attorney, Agent, or Firm*—Harness, Dickey & Pierce, P.L.C.

(57) ABSTRACT

The resonator of the present invention includes a cylindrical dielectric and a conductor film covering the surface of the dielectric in close contact therewith. The conductor film is constructed of a cylindrical portion and two flat portions, and is formed by subjecting the surface of the dielectric to metallization or the like. With the conductor film formed in close contact with the dielectric, deterioration of the Q value and the like caused by instability of connection at the corners can be suppressed even when a radio frequency induced current flows from the cylindrical portion over the two flat portions.

7 Claims, 16 Drawing Sheets

RESONATOR AND HIGH-FREQUENCY FILTER

CROSS-REFERENCE TO RELATED APPLICATIONS

This application is a continuation of U.S. patent application Ser. No. 09/881,235 filed on Jun. 14, 2001 now U.S. Pat. No. 6,750,739. The disclosure(s) of the above application(s) is (are) incorporated herein by reference. This application claims the benefit of Japanese Patent Application No. 2000-180401 filed Jun. 15, 2000 and Japanese Patent Application No. 2000-274618 filed Sep. 11, 2000.

BACKGROUND OF THE INVENTION

The present invention relates to a resonator constituting a radio frequency filter and the like, used for a radio frequency circuit device of a mobile communication system and the like.

Conventionally, a radio frequency communication system indispensably requires a radio frequency circuit element basically constructed of a resonator, such as a radio frequency filter. As a resonator for a low-loss radio frequency filter, often used is a dielectric resonator including a dielectric secured in a conductor shield.

FIGS. 19A and 19B are a perspective view and a cross-sectional view, respectively, of a conventional dielectric resonator 503 often used for a low-loss dielectric filter, which operates in a $TE_{01\delta}$ mode as the base mode. The dielectric resonator 503 includes a cylindrical dielectric 501 and a cylindrical case 502 surrounding the dielectric 501 with a space therebetween. The dielectric 501 is mounted on a support and connected to the bottom portion of the case 502 via the support. The ceiling of the case 502 is apart from the top surface of the dielectric 501 by a given distance, and the sidewall (cylindrical portion) of the case 502 is apart from the cylindrical face of the dielectric 501 by a given distance.

Note that the case 502 is actually constructed of a case body and a lid as shown in FIG. 20 although it is shown in a simplified form in FIGS. 19A and 19B.

The above resonator using a TE mode (hereinafter, referred to as a "TE-mode resonator") is superior to resonators using other modes in that it is small in loss and exhibits a good Q value, but has a disadvantage of being large in volume. Therefore, when a small resonator is desired, a resonator using a mode other than the TE mode as the base mode is used in some cases at the expense of the Q value characteristic to some extent.

FIG. 20 is a cross-sectional view of a radio frequency filter 530 having a resonator using a TM mode (hereinafter, referred to as a "TM-mode resonator") that is considered a promising candidate for downsizing implementation. The resonator shown in FIG. 20 uses a TM mode called a $TM_{010}$ mode among the other TM modes.

Referring to FIG. 20, the radio frequency filter 530 includes a cylindrical dielectric 540 and a case 531 composed of a case body 532 for housing the dielectric 540 and a lid 533. The case body 532 and the lid 533 are tightened together with bolts 535 so that the bottom surface of the lid 533 is in contact with the top face of the sidewall of the case body 532. The bottom surface of the lid 533 and the top surface of the bottom portion of the case body 532 are in contact with the top and bottom surfaces of the dielectric 540, respectively. In other words, the dielectric 540 is sandwiched between the lid 533 and the case body 532. The sidewall (cylindrical portion) of the case body 532 concentrically surrounds the dielectric 540 with a space therebetween. An input coupling probe 536 for input coupling with the dielectric 540 and an output coupling probe 537 for output coupling with the dielectric 540 are formed at the bottom portion of the case body 532.

However, it was found that the $TM_{010}$ mode resonator shown in FIG. 20 failed to provide expected filter characteristics when it was actually prototyped. The present inventors consider the reason for this failure is as follows.

In the TE mode ($TE_{01\delta}$ mode) resonator shown in FIGS. 19A and 19B, most of electromagnetic energy is confined within the dielectric, and only a small amount of radio frequency current flows to the side portion of the case 502. However, in the TM mode resonator shown in FIG. 20, a radio frequency 20 induced current flows in the side portion of the case body 532 in a direction parallel to the axial direction. Therefore, conductor loss comparatively largely influences the TM mode resonator. In particular, a large current flows across the corner at which the sidewall of the case body 532 and the lid 533 meet forming a connection Rcnct. If contact failure occurs at the connection Rcnct during the actual assembly of the resonator 530, this will presumably cause large deterioration in Q value and instability of operation. In addition, it has been found that if a gap exists between the top or bottom surface of the dielectric 540 and the lid 533 or the case body 532 due to size errors of components during the manufacture and the like, the resonant frequency sharply increases, and this possibly causes instability of operation. In particular, in the case of assembling a plurality of resonators to construct a filter, it is required to accurately fix the resonant frequency of the plurality of resonators. Therefore, in order to obtain desired filter characteristics while being free from instability of operation, considerably complicated work is presumably required.

In construction of a radio frequency filter using either type of resonator, the TE mode resonator or the TM mode resonator, the following three functions are important: that is, (1) securing intense input/output coupling having a desired fractional bandwidth;

(2) having a resonant frequency adjusting mechanism that can reduce deterioration in the Q value of the resonator and also easily secure a wide frequency adjustable range; and (3) having an inter-stage coupling degree adjusting mechanism that can easily secure a wide coupling degree adjustable range in the case of constructing a multi-stage radio frequency filter having a plurality of resonators. It is desired to implement a radio frequency filter having these functions.

SUMMARY OF THE INVENTION

A first object of the present invention is providing a dielectric resonator and a radio frequency filter that are small in size, have a simple structure, and operate stably.

A second object of the present invention is providing a radio frequency filter having the functions (1) to (3) described above.

The first resonator of the present invention includes: a columnar dielectric; and a shielding conductor surrounding the dielectric, the resonator using a resonant mode causing generation of a current crossing a corner of the columnar dielectric, wherein the shielding conductor is formed in direct contact with the surface of the dielectric.

With the above construction, the corner of the resonator is constructed of the continuous shielding conductor. Therefore, even in the resonator using a TM mode in which a radio frequency induced current flows over the side face of the column parallel to the axial direction of the column and the end face thereof orthogonal to the axial direction, good conduction is secured, and stability against vibration and the like is secured. Thus, deterioration in Q value and instability of operation are suppressed, and the characterbility of operation are suppressed, and the characteristics of the TM mode resonators of being able to be downsized and having a good Q value can be provided.

The dielectric may include a center portion and an outer portion covering at least part of the center portion, and the dielectric constant of the center portion is higher than the dielectric constant of the outer portion. This reduces conductor loss particularly at the cylindrical portion, and thus improves the unloaded Q value.

The columnar dielectric may be in a shape of a cylinder or a square pole. This facilitates the manufacture.

The shielding conductor may be a metallized layer formed on the surface of the dielectric. This provides high adhesion to the dielectric, and thus the effect is significant.

The second resonator of the present invention includes: a dielectric; and a case for housing the dielectric, wherein part of the case is constructed of conductive foil, and the conductive foil partly shields the dielectric electromagnetically.

With the above construction, the conductive foil is formed at a position such as a seam of the case in which electromagnetic shielding is unstable, to secure the electromagnetic shielding function. This stabilizes the operation characteristics of the resonator.

Preferably, the case includes a first portion and a second portion, the conductive foil is interposed between the first portion and the second portion, and the dielectric is electromagnetically shielded by the first portion and the conductive foil. With the conductive foil interposed at the connection between the first and second portions, vibration can be absorbed by the conductive foil if generated between the first and second portions, thereby suppressing deterioration in connection between the first and second portions. This suppresses deterioration in Q value and improves the stability of operation.

Preferably, the case includes a first portion and a second portion, the conductive foil is interposed, between the dielectric and the second portion of the case, and the dielectric is sandwiched between the first portion and the second portion of the case. This nicely sustains the contact between the dielectric and the conductive foil, and thus suppresses occurrence of problems such as sharp increase in resonant frequency.

The resonator may further include an elastic layer interposed between the conductive foil and the second portion. This provides the effect of absorbing vibration more significantly.

The resonant mode of the resonator may include a TM mode. This nicely secures the conduction between the first portion and the conductive foil.

The third resonator of the present invention includes: a dielectric having a hole; a case surrounding the dielectric; and a conductor rod inserted into the hole of the dielectric, the insertion depth of the conductor rod being variable, wherein a resonant frequency is adjusted with the insertion depth of the conductor rod into the hole.

With the above construction, the resonant frequency can be easily adjusted over a wide range without deteriorating the unloaded Q value in a practical level.

The first radio frequency filter of the present invention includes: a dielectric; a conductor member for electromagnetically shielding the dielectric; a conductor probe extending from a portion of the conductor member through a space defined by the conductor member to reach another portion of the conductor member, for coupling the dielectric with an external input signal or an external output signal.

With the above construction, intense input/output coupling is obtained between the dielectric and an external signal even when the radio frequency filter is downsized. This makes it possible to provide a small filter having a good Q value.

The second radio frequency filter of the present invention is a radio frequency filter having a columnar resonator using a resonant mode causing generation of a current crossing a corner, the resonator including: a dielectric; and a shielding conductor surrounding the dielectric formed in direct contact with the surface of the dielectric.

With the above construction, the corner of the resonator is constructed of the continuous shielding conductor. Therefore, even in the resonator using a TM mode in which a radio frequency induced current flows over the side face of the column parallel to the axial direction of the column and the end face thereof orthogonal to the axial direction, good conduction is secured, and stability against vibration and the like is secured. Thus, it is possible to provide a radio frequency filter that can suppress deterioration in Q value and instability of operation, and uses the characteristics of the TM mode resonators of being able to be downsized and having a good Q value.

The third radio frequency filter of the present invention is a radio frequency filter having a resonator, the resonator including: a dielectric; and a case for housing the dielectric, wherein part of the case is constructed of conductive foil and the conductive foil partly shields the dielectric electromagnetically.

With the above construction, the conductive foil is formed at a position such as a seam of the case in which electromagnetic shielding is unstable, to secure the electromagnetic shielding function. Thus, a radio frequency filter having a resonator with stable operation characteristics can be provided.

The fourth radio frequency filter of the present invention is a radio frequency filter having a resonator, the resonator including: a dielectric having a hole; a case surrounding the dielectric; and a conductor rod inserted into the hole of the dielectric, the insertion depth of the conductor rod being variable, wherein a resonant frequency is adjusted with the insertion depth of the conductor rod into the hole.

With the above construction, it is possible to provide a radio frequency filter having a resonator of which the resonant frequency can be easily adjusted over a wide range without deteriorating the unloaded Q value in a practical level.

The fifth radio frequency filter of the present invention is a radio frequency filter having a plurality of resonators at least including an input-stage resonator having a dielectric and receiving a radio frequency signal from an external device and an output-stage resonator having a dielectric and outputting a radio frequency signal to an external device. The radio frequency filter includes: a case surrounding the plurality of resonators for electromagnetically shielding the respective resonators; a partition formed between resonators of which electromagnetic fields are coupled with each other among the plurality of resonators; an inter-stage coupling window formed at the partition; and an inter-stage coupling degree adjusting member made of a conductor rod for adjusting the area of the inter-stage coupling window.

Thus, in the construction of a multi-stage radio frequency filter having a plurality of resonators, it is possible to provide an inter-stage coupling degree adjusting mechanism that is simple and has a wide coupling degree adjustable range, between adjacent ones of the plurality of resonators.

DESCRIPTION OF THE PREFERRED EMBODIMENTS

Hereinafter, preferred embodiments of the present invention will be described with reference to the accompanying drawings.

Embodiment 1

Figure 1A:
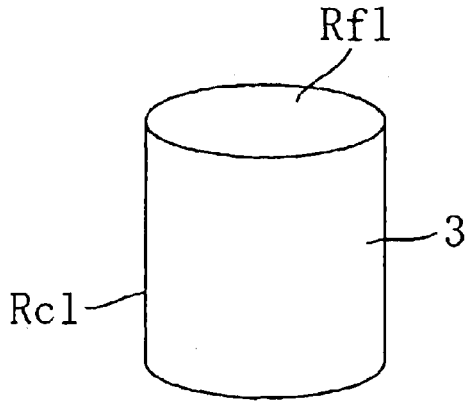
FIGS. 1A and 1B are a perspective view and a cross-sectional view, respectively, of a resonator of EMBODIMENT 1 of the present invention.
Figure 1B:
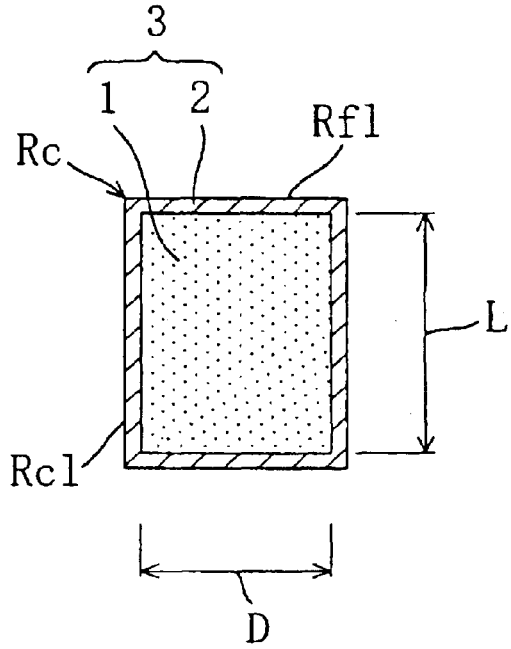

FIGS. 1A and 1B are a perspective view and a cross-sectional view, respectively, of a resonator 3 of EMBODIMENT 1 of the present invention. Referring to FIGS. 1A and 1B, the resonator 3 of this embodiment includes a cylindrical dielectric 1 made of a dielectric ceramic material or the like and a conductor film 2 covering substantially the entire surface of the dielectric 1 in close contact therewith. The resonator 3 uses the $TM_{010}$ mode described above as the resonant mode. The conductor film 2 is composed of a cylindrical portion Rcl covering the cylindrical face of the dielectric 1 and two flat portions Rfl covering the top and bottom surfaces of the dielectric 1. The conductor film 2 is formed by a process (so-called metallization) in which particulates of metal silver are attached to the entire surface of the dielectric 1 and then melted to thereby allow the metal silver and the dielectric 1 to be bonded together with a product of the reaction between the dielectric material and the silver. Thus, the feature of this embodiment is that the conductor film 2 covers the entire surface of the dielectric 1 in close contact therewith.

It should be noted that a hole for mounting the dielectric 1 in a case and the like may be formed at part of the dielectric 1, or an inter-stage coupling window may be formed through the conductor film 2, as will be described in relation to other embodiments to follow. In these cases, since no conductor film is formed at the portions where the hole and the window are formed, the conductor film 2 does not necessarily cover the entire surface of the dielectric 1. The present invention is also applicable to these cases.

The shape of the dielectric according to the present invention is not necessarily a circular cylinder, but may be another shape of cylinder such as an elliptic cylinder, or a pole having a polygonal cross section such as a square pole and a hexagonal pole. For example, a resonator using a square pole-shaped dielectric that has the same volume as the resonator using the cylindrical dielectric can exhibit substantially the same characteristics.

Figure 2:
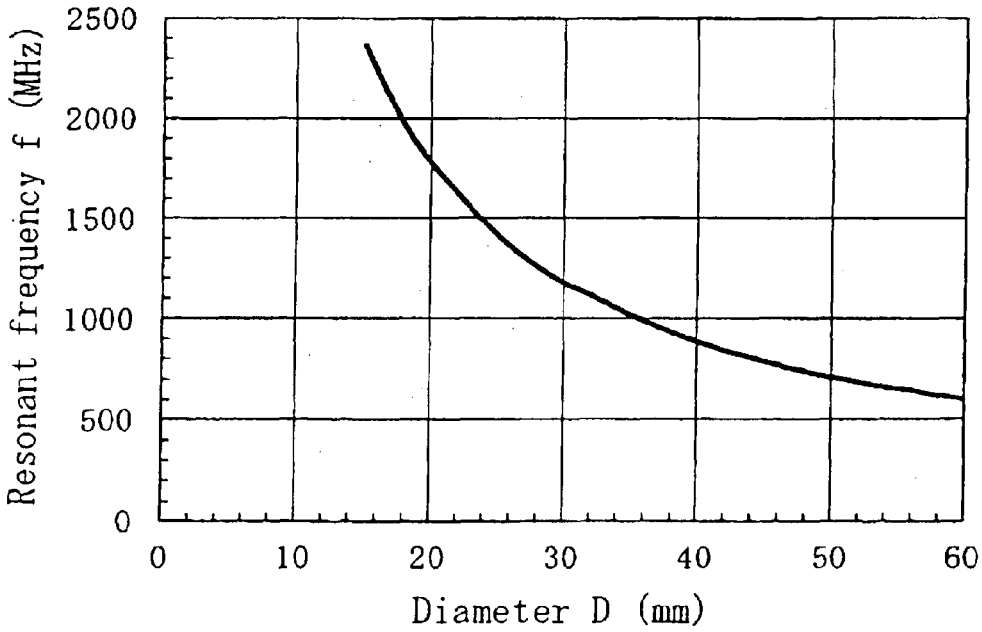
FIG. 2 is a view showing the results of simulation of the correlation between the diameter D and the resonant frequency f of the resonator.
Figure 3:
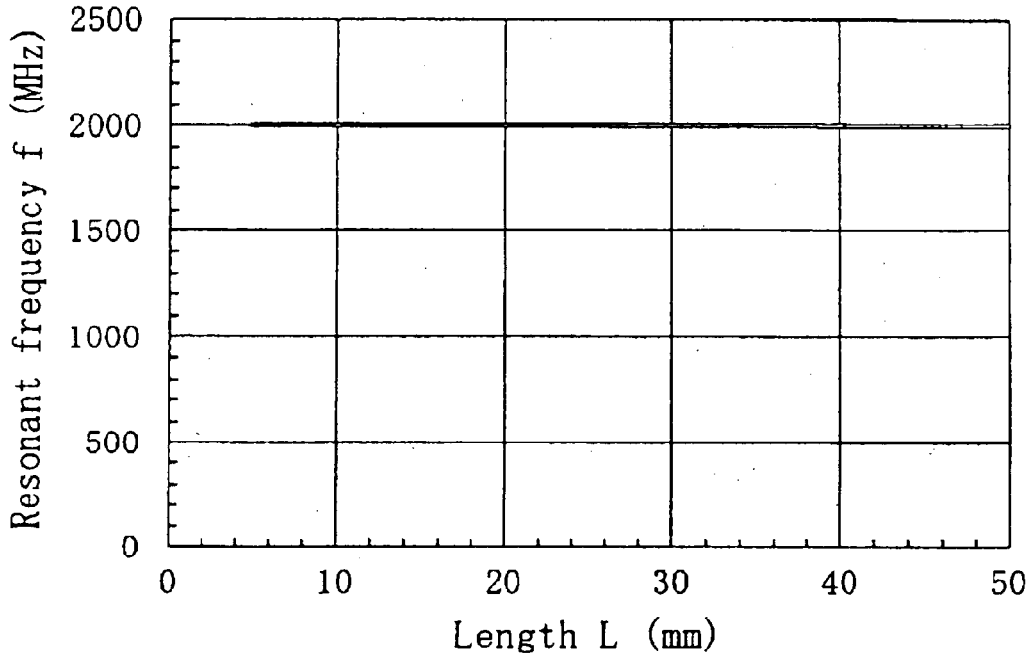
FIG. 3 is a view showing the results of simulation of the correlation between the axial length L and the resonant frequency f of the resonator with the diameter D being fixed.
Figure 4:
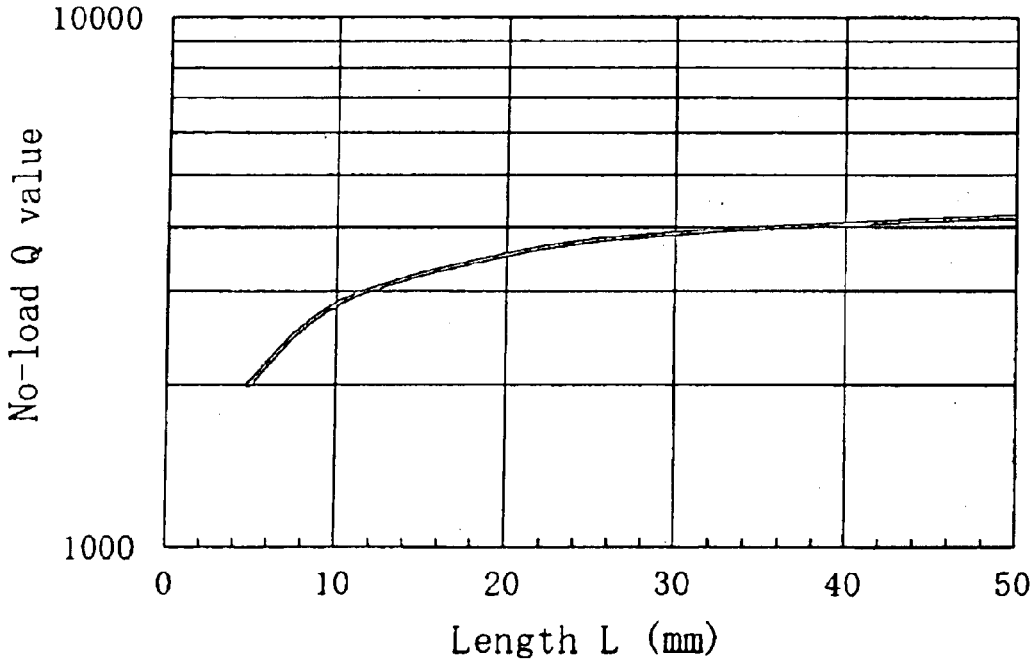
FIG. 4 is a view showing the results of calculation of the unloaded Q value with respect to the length L of the resonator with the diameter D being fixed.

FIGS. 2 through 4 are views showing the correlations between the resonant frequency in the $TM_{010}$ mode and the structure of the resonator of this embodiment in various parameters. In all cases, the relative dielectric constant of the dielectric 1 is 42. FIG. 2 shows the results of simulation of the correlation between the diameter D (see FIG. 1) and the resonant frequency of the resonator 3. FIG. 3 shows the results of simulation of the correlation between the axial length L (see FIG. 1) and the resonant frequency f of the resonator 3 obtained when the diameter D thereof is a fixed value (17 mm). FIG. 4 shows the results of calculation of the unloaded Q value with respect to the length L of the resonator 3 obtained when the diameter D thereof is 17 mm (f=2 GHZ).

As is found from FIG. 2, the resonant frequency f varies with the diameter D. That is, the resonant frequency f is higher as the diameter D is smaller. As is found from FIG. 3, the resonant frequency f is constant (2000 MHz) irrespective of the change of the length L under this condition (D=17 mm), As is found from FIG. 4, the unloaded Q value of the resonator 3 varies with the axial length L of the resonator 3. That is, the unloaded Q value is smaller as the length L is smaller.

In other words, in order to obtain a resonator with a higher frequency and a larger unloaded Q value, the resonator 3 is preferably designed to give a small value to the diameter D and a comparatively large value to the length L.

In this embodiment, the $TM_{010}$ mode resonator was described. The present invention is also applicable to TM mode resonators other than the $TM_{010}$ mode resonator and resonators in a resonant mode of a hybrid wave that has both an electric field component and a magnetic field component in the direction of the propagation of an electromagnetic wave. In these cases, also, substantially the same effects as those obtained in this embodiment can be obtained.

In particular, among other TM modes, the $TM_{010}$ mode, which is the lowest order resonant mode, enables formation of a downsized resonator and thus is practically advantageous.

EXAMPLE

The dielectric 1 having the structure shown in FIG. 1 was produced using a dielectric ceramic material having a dielectric constant of 42 and a dielectric loss tangent of 0.00005. Silver paste was applied to the entire surface of the dielectric 1. The resultant dielectric was heated to a temperature equal to or more than the melting temperature of silver, to metallize the surface of the dielectric 1 and thus form the conductor film 2. The resonance characteristics of the thus-produced resonator 3 were evaluated by experiment. The size of the dielectric 1 was L=18 mm and D=17 mm, and the volume was about 4.1 $cm^3$.

The evaluation was performed in the following manner. Holes (bottomed holes) were formed at portions of the flat surfaces Rfl of the conductor film 2 and portions of the dielectric 1 adjacent to the respective portions of the conductor film 2. A core conductor constituting a coaxial line was inserted into each of the holes by a small length, to excite the resonator with a signal supplied through the coaxial line to generate $TM_{010}$ mode resonance. The upper and lower coaxial lines were connected to a network analyzer, and from the passing characteristics, the resonant frequency f and the unloaded Q value were measured.

From the results of the above measurement, it was found that the resonant frequency f was 2.1 GHz and the unloaded Q value was about 1300. There was observed no fluctuation in resonant frequency due to vibration of the resonator and the like.

When it is attempted to produce a $TE_{01\delta}$ mode resonator having the same resonant frequency f as that of the resonator of this example using the same dielectric material as that of the resonator of this example, the volume of the resonator will be as large as about 72 $cm^3$. The volume of the resonator of this example is about 4.08 $(\pi/4)\times1.7\times1.8\approx4.08$ ($cm^3$). This means that the $TM_{010}$ mode resonator of this example can be reduced in volume to about 1/17 of the $TE_{01\delta}$ mode resonator using the same dielectric material and having the same resonant frequency f.

Figure 20:
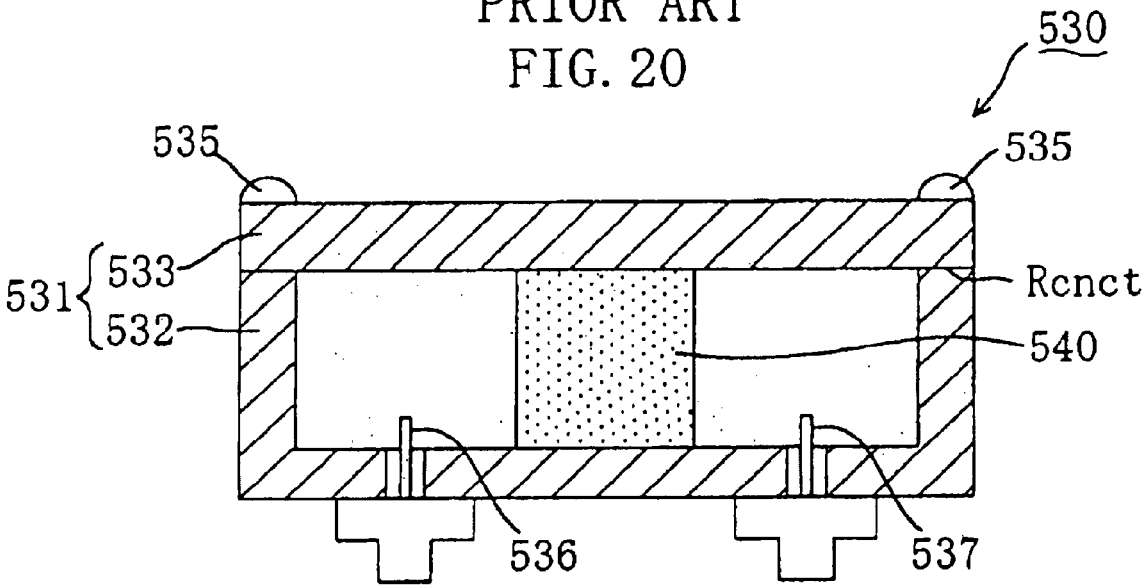
PRIOR ART FIG. 20
FIG. 20 is a cross-sectional view of a conventional radio frequency filter using a TM mode resonator.

The $TM_{010}$ mode resonator of this embodiment has the following advantage over the conventional $TM_{010}$ mode resonator shown in FIG. 20.

As described above, the conventional $TM_{010}$ mode resonator includes the case 531 surrounding the dielectric 540 as a shielding conductor. A radio frequency induced current flows across the connection Rcnct (corner) between the case body 532 and the lid 533, and therefore, the conducting state at the connection Rcnct greatly influences the filter characteristics of the resonator. However, since the connection Rcnct shown in FIG. 20 is obtained by tightening the case body 532 and the lid 533 together with mounting bolts or by welding the case body 532 and the lid 533 together, it is difficult to secure good conduction of a radio frequency induced current at the connection Rcnct. In addition, the conducting state at the connection Rcnct may be changed due to vibration and the like after the formation of the case 531. As a result, in the conventional $TM_{010}$ resonator, the filter characteristics may possibly vary.

On the contrary, in this embodiment, the conductor film 2 is formed in close contact with the dielectric 1 by metallization or the like, to be used as the shielding conductor of the resonator 3. The conductor film 2, which is composed of the flat portions Rfl and the cylindrical portion Rcl extending continuous to each other, is free from conduction failure at corners Rc as the boundaries between the cylindrical portion Rcl and the flat portions Rfl and exhibits stable operation against vibration and the like. Therefore, the resonator of this embodiment can suppress the problems of deterioration in Q value and instability of operation, and can secure the characteristics of the $TM_{010}$ mode resonators of being able to be downsized and having a large Q value. In addition, the manufacturing process can be simplified.

Thus, the $TM_{010}$ mode resonator of this embodiment can provide advantages, over the conventional resonators, of simplifying the manufacturing process, improving the mechanical strength, securing the stability of operation against vibration and the like, and being downsized.

The conductor film for covering the surface of the dielectric can be formed, not only by metallization described above, but also by other methods for forming the conductor film in close contact with the surface of the dielectric, such as spraying of molten metal onto the surface of the dielectric and pressing of a metal plate to the dielectric.

Embodiment 2

Figure 5:
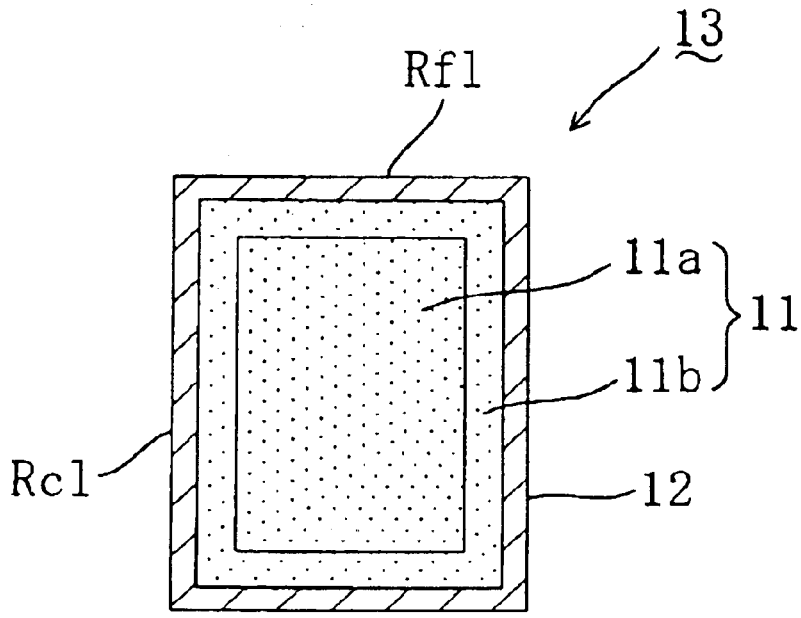
FIG. 5 is a cross-sectional view of a resonator of EMBODIMENT 2 of the present invention.

FIG. 5 is a cross-sectional view of a resonator 13 of EMBODIMENT 2 of the present invention. The resonator 13 of this embodiment includes a dielectric 11 composed of a cylindrical high dielectric constant portion 11*a* made of a dielectric ceramic material or the like and a cylindrical low dielectric constant portion 11*b* surrounding substantially the entire surface of the high dielectric constant portion 11*a*. The resonator 13 further includes a conductor film 12 covering substantially the entire surface of the dielectric 11 in close contact therewith. The resonator 13 uses the $TM_{010}$ mode described above as the resonant mode. The conductor film 12 is composed of a cylindrical portion Rcl covering the cylindrical face of the low dielectric constant portion 11*b* and two flat portions Rfl covering the top and bottom surfaces of the low dielectric constant portion 11*b*.

In this embodiment, first, the dielectric 11 composed of the high dielectric constant portion 11*a* and the low dielectric constant portion 11*b* surrounding the high dielectric constant portion 11*a* is formed. The dielectric 11 is then subjected to a process (so-called metallization) in which particulates of metal silver are attached to the entire surface of the low dielectric constant portion 11*b* and then melted to form the conductor film 12. Thus, the feature of this embodiment is that the conductor film 12 covers the entire surface of the low dielectric constant portion 11*b* of the dielectric 11 in close contact therewith.

It should be noted that a hole for mounting the dielectric 11 in a case and the like may be formed at part of the dielectric 11, or an inter-stage coupling window may be formed through the conductor film 2, as will be described in relation to other embodiments to follow. In these cases, since no conductor film is formed at the portions where the hole and the window are formed, the conductor film 12 does not necessarily cover the entire surface of the dielectric 11. The present invention is also applicable to these cases.

The shape of the dielectric 11 (the combined shape of the high dielectric constant portion 11*a* and the low dielectric constant portion 11*b*) according to the present invention is not necessarily a circular cylinder, but may be another cylinder such as an elliptic cylinder, or a pole having a polygonal cross section such as a square pole and a hexagonal pole. For example, a resonator using a square pole-shaped dielectric that has the same volume as the resonator using the cylindrical dielectric can exhibit substantially the same characteristics.

In the resonator 13 of this embodiment, the flat portions Rfl and the cylindrical portion Rcl of the conductor film 12 constitute a continuous one film, and the conductor film 12 covers substantially the entire surface of the dielectric 11 (the lower dielectric constant portion 11*b*). Accordingly, substantially the same effects as those obtained in EMBODIMENT 1 can be obtained.

In addition, the resonator of this embodiment is found superior to the resonator shown in FIG. 1 in that the conductor loss at the cylindrical portion Rcl is especially reduced and thus the no-loss Q value is improved.

In this embodiment, the $TM_{010}$ mode resonator was described. The present invention is also applicable to TM mode resonators other than the $TM_{010}$ mode resonator and resonators in the hybrid wave resonant mode. In these cases, also, substantially the same effects as those obtained in this embodiment can be obtained.

(Modification)

Figure 6:
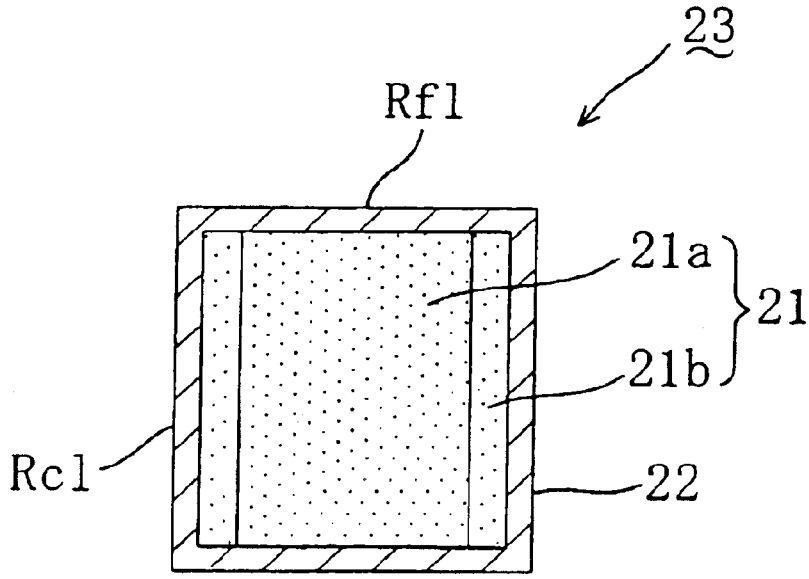
FIG. 6 is a cross-sectional view of a resonator of a modification of EMBODIMENT 2 of the present invention.

FIG. 6 is a cross-sectional view of a resonator 23 of a modification of EMBODIMENT 2 of the present invention. The $TM_{010}$ mode resonator 23 of this modification includes a dielectric 21 composed of a cylindrical high dielectric constant portion 21*a* made of a dielectric ceramic material or the like and a cylindrical low dielectric constant portion 21*b* surrounding only the cylindrical face of the high dielectric constant portion 21*a*. In other words, the top and bottom surfaces of the high dielectric constant portion 21*a* are not covered with the low dielectric constant portion 21*b*. The resonator 23 further includes a conductor film 22 covering substantially the entire surface of the dielectric 21 in close contact therewith. The conductor film 22 is composed of a cylindrical portion Rcl covering the cylindrical face of the low dielectric constant portion 21*b* of the dielectric 21 and two flat portions Rfl covering the top and bottom surfaces of the high dielectric constant portion 21*a* and the top and bottom faces of the low dielectric constant portion 21*b*.

In this modification, first, the dielectric 21 composed of the high dielectric constant portion 21*a* and the low dielectric constant portion 21*b* surrounding the cylindrical face of the high dielectric constant portion 21*a* is formed. The dielectric 21 is then subjected to a process (so-called metallization) in which particulates of metal silver are attached to the exposed surfaces of the high dielectric constant portion 21*a* and the low dielectric constant portion 21*b* and then melted to thereby allow the metal silver and the dielectric 21 to be bonded together with a product of the reaction between the dielectric material and the silver, to form the conductor film 22. Thus, the feature of this modification is that the conductor film 22 covers substantially the entire surface of the dielectric 21 in close contact with the high dielectric constant portion 21*a* and the low dielectric constant portion 21*b* of the dielectric 21.

It should be noted that a hole for mounting the dielectric 21 in a case and the like may be formed at both or either one of the top and bottom surfaces of the dielectric 21 as will be described in relation to other embodiments to follow. In this case, the conductor film 12 does not necessarily cover the entire surface of the dielectric 21. The present invention is also applicable to these cases.

The shape of the dielectric 21 (the combined shape of the high dielectric constant portion 21*a* and the low dielectric constant portion 21*b*) is not necessarily a circular cylinder, but may be another cylinder such as an elliptic cylinder, or a pole having a polygonal cross section such as a square pole and a hexagonal pole. For example, a resonator using a square pole-shaped dielectric that has the same volume as the resonator using the cylindrical dielectric can exhibit substantially the same characteristics.

In this modification, the conductor loss at the top and bottom plat portions Rfl slightly increases compared with the resonator shown in FIG. 5, but this modification provides an advantage that further downsizing of the resonator is possible.

Embodiment 3

Figure 7:
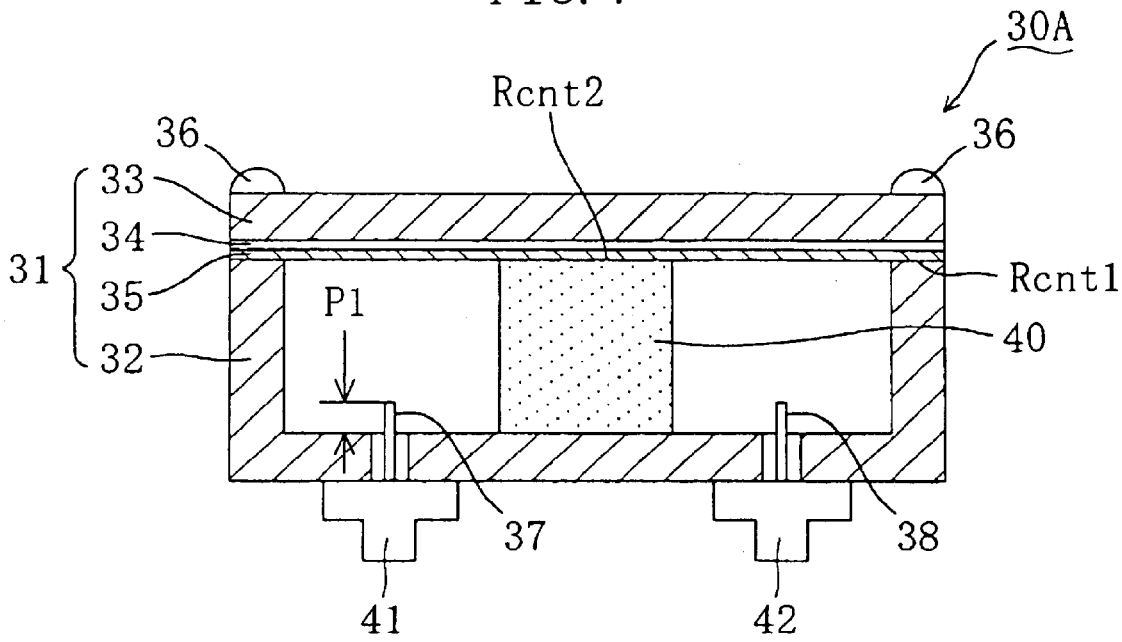
FIG. 7 is a cross-sectional view of a radio frequency filter using a TM mode resonator of EMBODIMENT 3 of the present invention.

FIG. 7 is a cross-sectional view of a radio frequency filter 30A using a TM mode resonator of EMBODIMENT 3 of the present invention. Referring to FIG. 7, the radio frequency filter 30A includes a cylindrical dielectric 40 and a case 31. The case 31 includes a case body 32 for housing the dielectric 40 and a lid 33 as main components. A cushion layer 34 and conductive foil 35 are formed on the bottom surface of the lid 33. The case body 32 and the lid 33 are mechanically connected with each other by being tightened with mounting bolts 36 with the cushion layer 34 and the conductive foil 35 being sandwiched between the bottom surface of the lid 33 and the top face of the sidewall of the case body 32. The cushion layer 34 and the conductive foil 35 also exist between the bottom surface of the lid 33 and the top surface of the dielectric 40. Thus, the top surface of the dielectric 40 is in contact with the conductive foil 35, while the bottom surface thereof is in contact with the top surface of the bottom portion of the case body 32. In other words, the dielectric 40 is sandwiched between the lid 33 and the case body 32 with the interposition of the cushion layer 34 and the conductive foil 35.

The sidewall (cylindrical portion) of the case body 32 concentrically surrounds the cylindrical face of the dielectric 40 with a space therebetween. In this embodiment, therefore, the case body 32 and the conductive foil 35 provides an electromagnetic shield for the dielectric 40. Thus, the dielectric 40, the case body 32, the lid 33, the cushion layer 34, and the conductive foil 34 constitute a resonator.

An input coupling probe 37 for input coupling with the dielectric 40 and an output coupling probe 38 for output coupling with the dielectric 40 are placed at the bottom portion of the case body 32. Also placed are an input coaxial connector 41 for transmitting an input signal to the input coupling probe 37 from an external device and an output coaxial connector 42 for transmitting an output signal from the output coupling probe 38 to an external device. Specifically, the coaxial connectors 41 and 42 are placed at small holes formed through the bottom portion of the case body 32, and the input and output coupling probes 37 and 38 are soldered to the tips of the coaxial connectors 41 and 42. In this way, the resonator, the input coupling probe 37, and the output coupling probe 38 constitute a radio frequency filter using the resonator.

In this embodiment, the cushion layer 34 is deformed at a connection Rcnt1 between the sidewall of the case body 32 and the lid 33 by tightening the connection with the mounting bolts 36, to allow the sidewall of the case body 32 and the conductive foil 35 to come into close contact with each other. At the same time, the cushion layer 34 is also deformed at a connection Rcnt2 between the lid 33 and the dielectric 40, to allow the dielectric 40 and the conductive foil 35 to come into close contact with each other. In this way, the electromagnetic shield for the dielectric 40 is reliably secured by the case body 32 and the conductive foil 35.

In a TM mode resonator, a radio frequency induced current flows in the case body 32 and the conductive foil 35 so that a magnetic field is generated in a direction crossing the axis of the cylindrical dielectric. Therefore, a radio frequency induced current flows across the connection Rcnt1 between the case body 32 and the conductive foil 35. In this embodiment, since the conduction can be well secured between the case body 32 and the conductive foil 35 as described above, improvement in filter characteristics is possible.

In the manufacture of the radio frequency filter of this embodiment, the cushion layer 34 and the conductive foil 35 are bonded together in advance. The dielectric 40 is positioned inside the case body 32. The laminate of the cushion layer 34 and the conductive foil 35 is placed on the case body 32 and the dielectric 40, and then the lid 33 is placed on the laminate and secured to the case body 32 with the mounting bolts 36. At least four mounting bolts 36 are preferably used, and in the assembly of the case 31 with the mounting bolts 36, the mounting bolts are preferably fastened in sequence with each pair of bolts at the opposing positions at one time.

When the conductive foil is made of an elastic material, the cushion layer is not necessarily required.

In this embodiment, the $TM_{010}$ mode resonator was described. The present invention is also applicable to TM mode resonators other than the $TM_{010}$ mode resonator and resonators in the hybrid wave resonant mode. In these cases, also, substantially the same effects as those obtained in this embodiment can be obtained.

EXAMPLE

In this example, as the dielectric 40, used is a dielectric ceramic material having a diameter of 9 mm, an axial length of 10 mm, a dielectric constant of 42, and a dielectric loss tangent (tan δ) of 0.00005. As the case body 32, used is a bottomed cylinder made of oxygen-free copper having an inner diameter of 25 mm and an inner height of 10 mm. As the conductive foil 35, copper foil having a thickness of 0.05 mm is used. As the cushion sheet 34, used is a flexible polytetrafluoroethylene resin sheet (Product name: NITOFLON adhesive tapes No. 903 manufactured by Nitto Denko Corp.) having a thickness of 0.2 mm. A total of six mounting bolts 36 are mounted on the cylindrical case body 32 at equal intervals of 60° as is viewed from above. The torque for fastening the mounting bolts 36 may be about 100 N.m to about 200 N.m. The mounting bolts 36 may otherwise be fastened as far as the verge of rupture without use of a tool such as a torque wrench. The protrusion P1 of the input coupling probe 37 and the output coupling probe 38 from the bottom portion of the case body 32 is about 3 mm, for example.

The thickness of the copper foil as the conductive foil 35 is preferably in the range of about 0.02 mm to about 0.1 mm. The thickness of the cushion layer 34 depends on the material. It is preferably in the range of about 0.05 mm to about 0.3 mm when the material is that used in this example.

To verify the effect of the radio frequency filter of this embodiment, the resonance characteristics of the filter were experimentally evaluated. Specifically, a radio frequency signal was input to the input coupling probe 37 via the coaxial connector 41 to excite the $TM_{010}$ mode resonance, and the passing characteristics were retrieved from the output coupling probe 38 and measured with a network analyzer to obtain the resonant frequency and the unloaded Q value.

Figure 21:
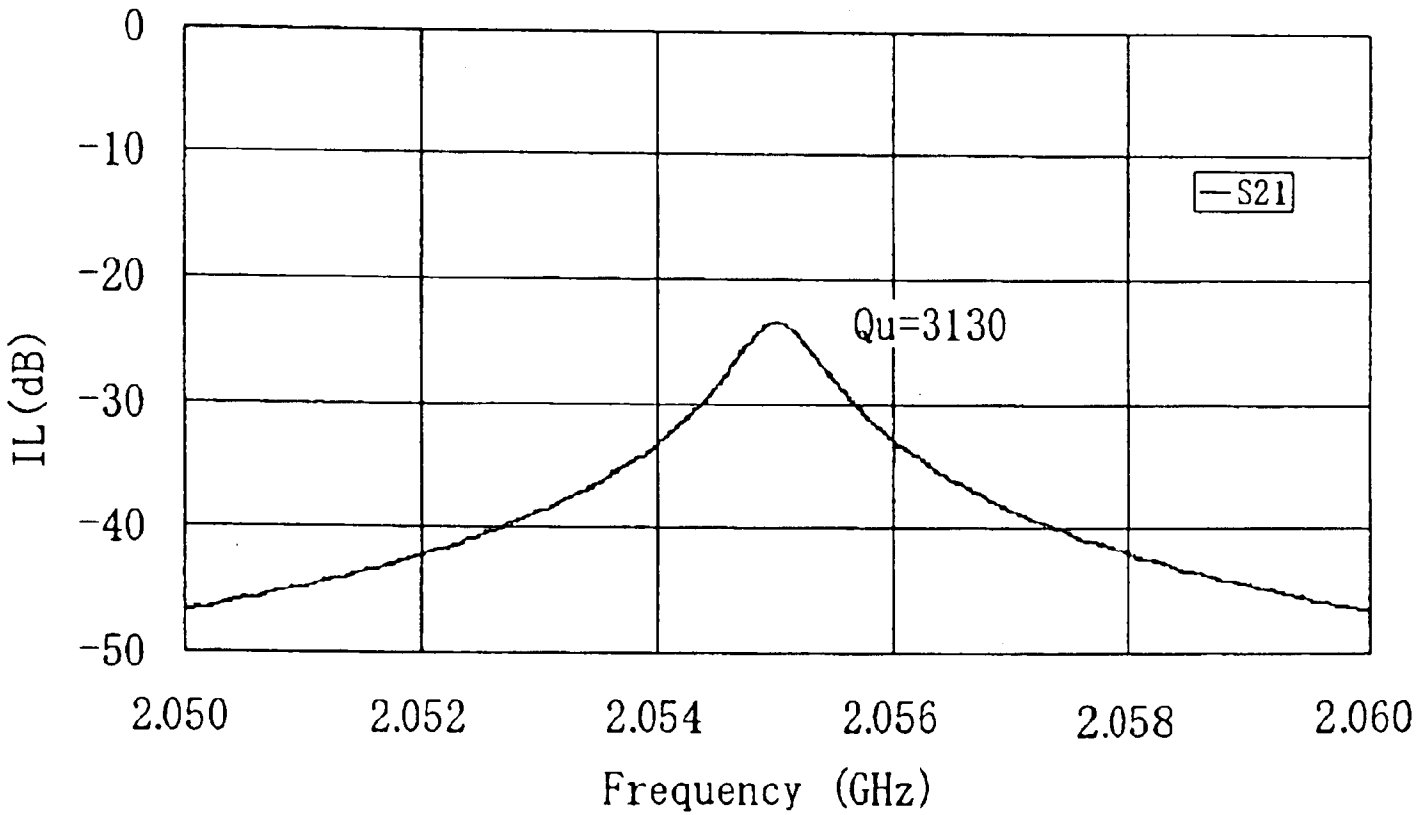
FIG. 21 is a view showing the results of measurement of resonance characteristics of a $TM_{010}$ mode resonator of an example of EMBODIMENT 3.

FIG. 21 shows the measurement results of the resonance characteristics of the $TM_{010}$ mode resonator in the example of EMBODIMENT 3. As is found from FIG. 21, in the radio frequency filter of this embodiment, the resonant frequency was 2.00 GHz, which was roughly equal to the design value, and the unloaded Q value of about 3200 was obtained stably with good reproducibility. No variation in resonant frequency due to mechanical vibration was observed.

The same evaluation was also performed for the conventional radio frequency filter shown in FIG. 20 for comparison. As the conventional filter, prepared was a radio frequency filter of which components had the same materials and sizes as those of the radio frequency filter of this example, except that the conductive foil 35 and the cushion layer 34 were not provided. As a result of the evaluation, in the conventional radio frequency filter, the resonant frequency greatly fluctuated with the fastening state of the mounting bolts, such as the degree of fastening torque for the mounting bolts. Actually, the resonant frequency was in the range of about 2.2 GHz to about 2.6 GHz, which was higher than the design value, and exhibited a large variation. The unloaded Q value also greatly fluctuated in the range of about 800 to about 3000. In addition, the resonant frequency delicately changed in response to mechanical vibration.

The reason why the radio frequency filter of this embodiment succeeded in stabilizing the Q value characteristic and increasing the Q value, compared with the Q value of the conventional radio frequency filter, is as follows. With the existence of the cushion layer 34, the adhesion at the connection Rcnt1 between the case body 32 and the lid 33 improved and also the contact state therebetween was stabilized even if size errors occurred in the components of the radio frequency filter. This improved the conduction of a radio frequency induced current.

Thus, in the $TM_{010}$ mode resonator of this embodiment having the construction described above, the operation was markedly stabilized against vibration and the like, compared with the conventional resonators.

Embodiment 4

Figure 8:
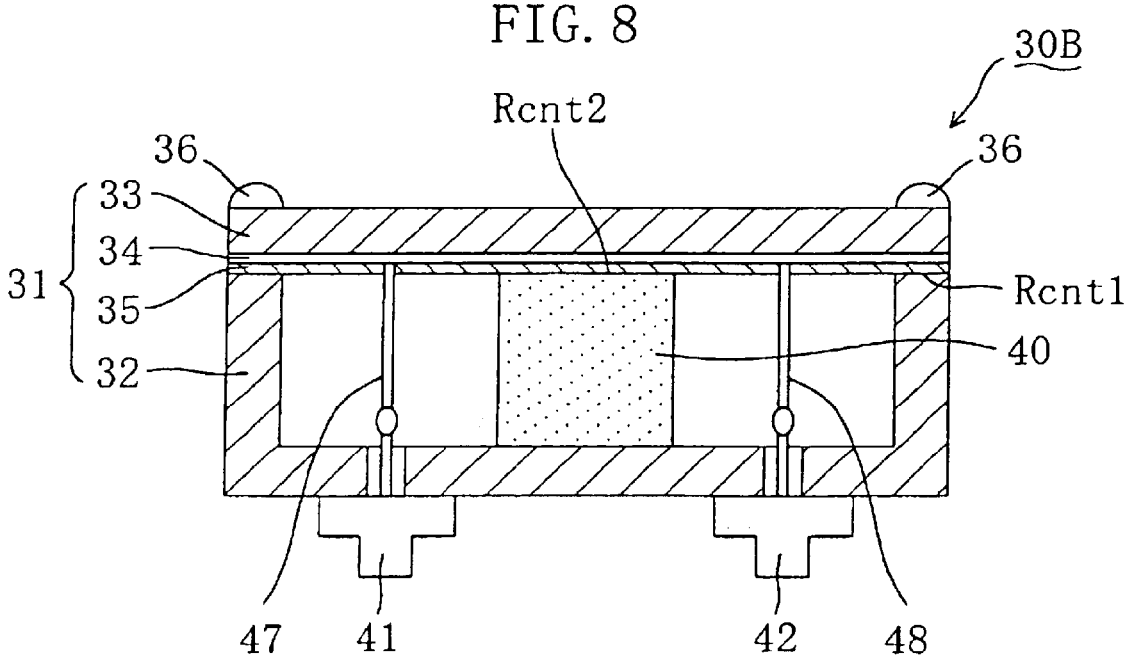
FIG. 8 is a cross-sectional view of a radio frequency filter using a TM mode resonator of EMBODIMENT 4 of the present invention.

FIG. 8 is a cross-sectional view of a radio frequency filter 30B using a TM mode resonator of EMBODIMENT 4 of the present invention. As shown in FIG. 8, the radio frequency filter 30B of this embodiment has basically the same construction as the radio frequency filter 30A of EMBODIMENT 3 shown in FIG. 7.

The feature of the radio frequency filter 30B of this embodiment is the input/output coupling mechanism different from that in EMBODIMENT 3. That is, in place of the input coupling probe 37 and the output coupling probe 38 in EMBODIMENT 3, the radio frequency filter 30B of this embodiment includes an input coupling probe 47 and an output coupling probe 48, which extend in the space defined by the case body 32 to come into contact with the conductive foil 35. In addition, in this embodiment, the shape of the case 31 may not necessarily be a cylinder as in EMBODIMENT 3, but may be a square pole. In the latter case, the mounting bolts 36 may be provided at the four corners.

The structures and the functions of other components of the radio frequency filter 30B of this embodiment are substantially the same as those in EMBODIMENT 3. Therefore, these components shown in FIG. 8 are denoted by the same reference numerals as those in FIG. 7, and the description thereof is omitted here.

In this embodiment, the input coupling probe 47 and the output coupling probe 48 are soldered to the corresponding portions of the conductive foil 35, so that the coupling probes 47 and 48 are conducting with the conductive foil 35. In this embodiment, the input coupling probe 47 and the output coupling probe 48 are made of a silver-plated copper line having a diameter of 0.8 mm. The diameter of the silver-plated copper line is preferably in the range of about 0.5 mm to about 1 mm.

In this embodiment, the $TM_{010}$ mode resonator was described. The present invention is also applicable to TM mode resonators other than the $TM_{010}$ mode resonator, resonators in a hybrid wave resonant mode, and TE mode resonators. In these cases, also, substantially the same effects as those obtained in this embodiment can be obtained.

EXAMPLE

In this example, as the dielectric 40, used is a dielectric ceramic material having a diameter of 9 mm, an axial length of 10 mm, a dielectric constant of 42, a dielectric loss tangent (tan δ) of 0.00005. As the case body 32, used is a bottomed container made of oxygen-free copper in the shape of a square pole having an inner side of 25 mm and an inner height of 10 mm. As the conductive foil 35, copper foil having a thickness of 0.05 mm is used. As the cushion sheet 34, used is a flexible Teflon resin sheet (Product name: NITOFLON adhesive tapes No. 903 manufactured by Nitto Denko Corp.) having a thickness of 0.2 mm. A total of four mounting bolts 36 are mounted at the four corners of the square pole-shaped case body 32.

A radio frequency signal was supplied to the radio frequency filter of this embodiment from an external device via the input coaxial connector 41 to excite the $TM_{010}$ mode, and the passing characteristics were retrieved via the output coaxial connector 42 and measured to obtain an external Q value of input/output coupling (external input power/internal consumed power). The resonant frequency in the $TM_{010}$ mode using a 50 Ω line was 2.14 GHz. As an example of measurement of the degree of coupling, the input coaxial connector 41 and the output coaxial connector 42 were placed at positions apart from the center axis of the dielectric 40 by 8.5 mm in the lateral direction. As a result, a sufficiently small external Q value, about 60, was obtained.

The above external Q value corresponds to a degree of input/output coupling that is large enough to attain a radio frequency filter having a fractional bandwidth of about 1% in the case where a 4-stage radio frequency filter is manufactured by arranging four dielectrics 40 (resonators) and using the input coupling probe 47 and the output coupling probe 48 in this embodiment. A larger degree of coupling was obtained as the input coupling probe 47 and the output coupling probe 48 are placed closer to the center axis of the dielectric 40.

The degree of input/output coupling in this example was evaluated in comparison with that of an example of EMBODIMENT 3 shown in FIG. 7 where the protrusion P1 of the input and output coupling probes from the bottom portion of the case body was made as large as possible unless the probes did not come into contact with the ceiling of the case body, to obtain input/output coupling as intense as possible. That is, used was the case 31 (the case body 32, the lid 33, the cushion layer 34, and the conductive foil 35) having the same shapes and sizes as those of the example of EMBODIMENT 3, and only the input coupling probe 47 and the output coupling probe 48 were different from the input coupling probe 37 and the output coupling probe 38 in the example of EMBODIMENT 3.

The external Q value was 7000 in the example of EMBODIMENT 3 where the protrusion P1 of the input and output coupling probes 37 and 38 from the bottom portion of the case body 32 was 8 mm. On the contrary, the external Q value was as small as about 60 in the radio frequency filter of this embodiment provided with the input/output mechanism composed of the input coupling probe 47 and the output coupling probe 48. This indicates that markedly intense input/output coupling can be obtained by using the input/output coupling probes in this embodiment.

That is, in this embodiment, the following was confirmed. Intense input/output coupling can be attained by using the input/output coupling mechanism having the input coupling probe 47 and the output coupling probe 48 that extend from the bottom portion of the case body 31 to come into contact with the conductive foil 35, compared with the case of using the input/output coupling mechanism having the input coupling probe 37 and the output coupling probe 38 that do not reach the conductive foil 35 as in EMBODIMENT 3.

With the input/output coupling mechanism in this embodiment, therefore, intense coupling with the $TM_{010}$ mode can be easily obtained, enabling implementation of a filter using a resonator in this mode.

In this embodiment, the cushion layer 34 and the conductive foil 35 may not be provided, and the lid 33 and the case body 32 may be in direct contact with each other. In this case, also, intense input/output coupling can be obtained as long as the input coupling probe 47 and the output coupling probe 48 extend to be in contact with the lid 33.

Embodiment 5

Figure 9:
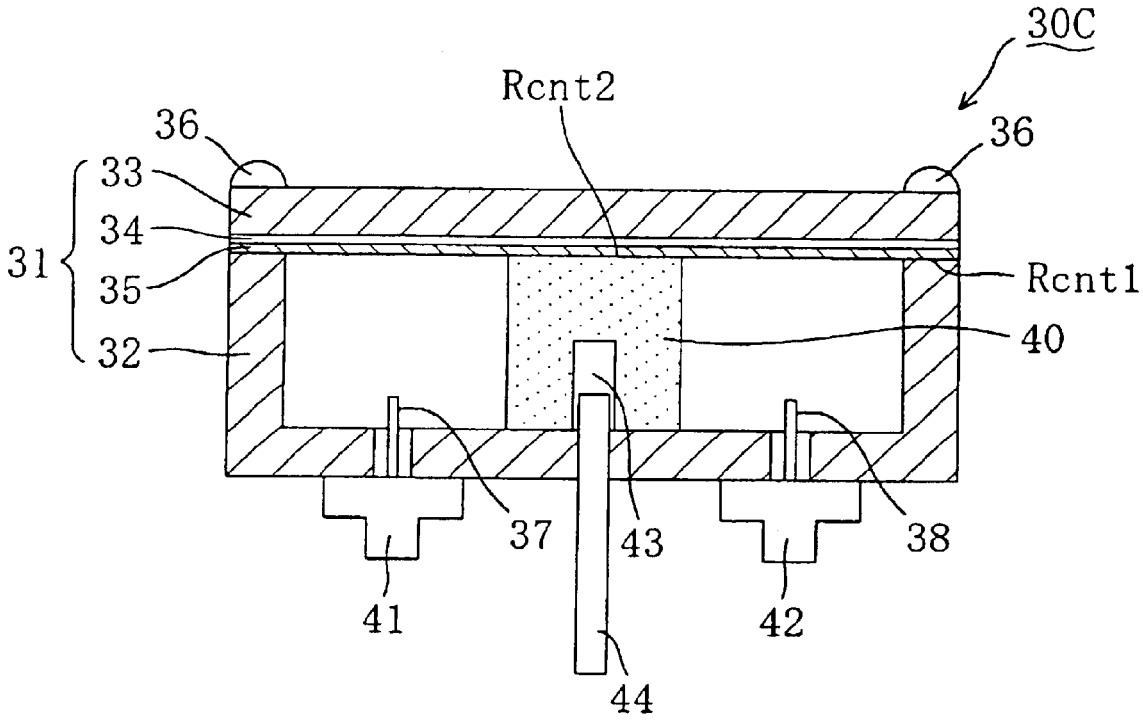
FIG. 9 is a cross-sectional view of a radio frequency filter using a TM mode resonator of EMBODIMENT 5 of the present invention.

FIG. 9 is a cross-sectional view of a radio frequency filter 30C using a TM mode resonator of EMBODIMENT 5 of the present invention. As shown in FIG. 9, the radio frequency filter 30C of this embodiment has basically the same construction as the radio frequency filter 30A of EMBODIMENT 3 shown in FIG. 7.

The feature of the radio frequency filter 30C of this embodiment is that a conductor rod 44 made of an M2 copper bolt has been inserted into the dielectric 40 from the bottom surface thereof, in addition to the structure in EMBODIMENT 3. The conductor rod 44 is inserted in the following manner. A hole 43 having a diameter of 2.4 mm and a depth of 8 mm, for example, is formed in advance at the bottom surface of the dielectric 40. The conductor rod 44 made of an M2 copper bolt, which engages with a threaded hole formed through the bottom portion of the case body 32, is inserted into the hole 43 of the dielectric 40.

The structures and the functions of the other components of the radio frequency filter 30C of this embodiment are substantially the same as those in EMBODIMENT 3. Therefore, these components shown in FIG. 9 are denoted by the same reference numerals as those in FIG. 7, and the description thereof is omitted here.

In this embodiment, as the insertion depth of the conductor rod 44 into the hole 43 increases, the resonant frequency in the $TM_{010}$ mode shifts to a lower frequency. Hereinafter, the dependency of the characteristics of the radio frequency filter 30C of this embodiment on the insertion depth will be described.

Figure 10:
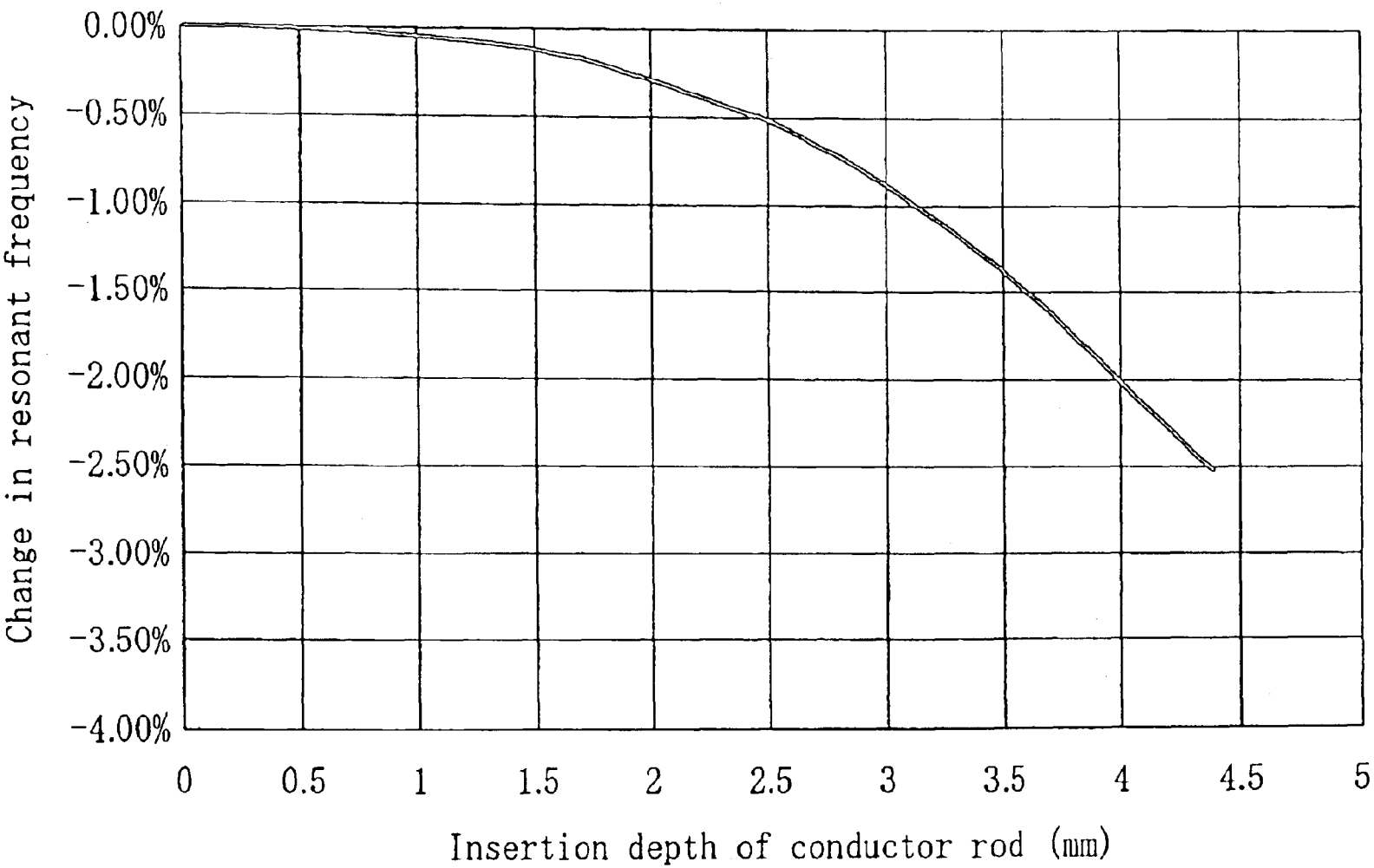
FIG. 10 is a characteristic view showing the results of measurement of the change in resonant frequency in the $TM_{010}$ mode with respect to the insertion depth of a conductor rod.
Figure 11:
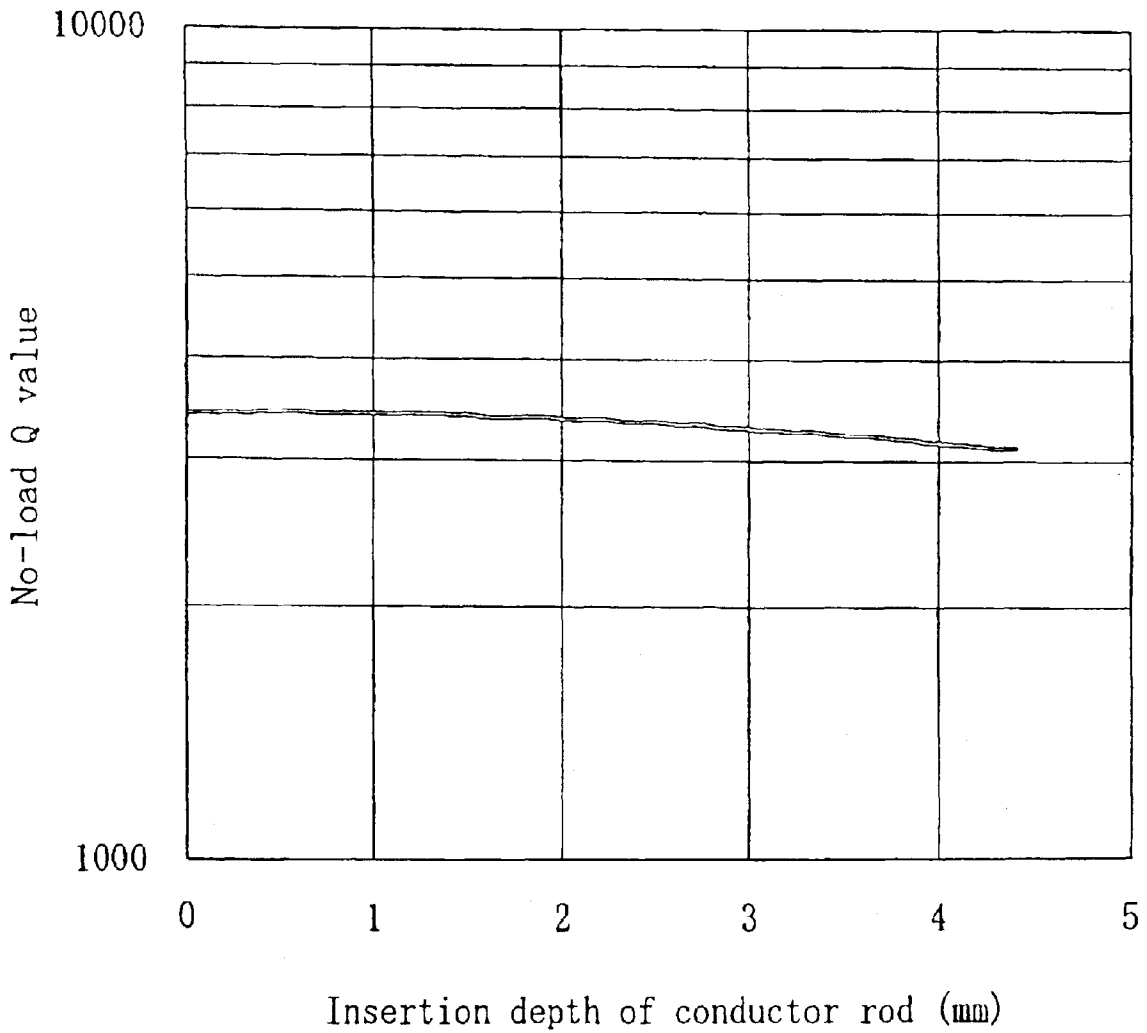
FIG. 11 is a characteristic view showing the results of measurement of the unloaded Q value in the $TM_{010}$ mode with respect to the insertion depth of a conductor rod.

FIG. 10 is a characteristic view showing the results of measurement of the change in resonant frequency in the $TM_{010}$ mode with respect to the insertion depth of the conductor rod. FIG. 11 is a characteristic view showing the results of measurement of the non-load Q value in the $TM_{010}$ mode with respect to the insertion depth of the conductor rod. As is found from FIGS. 11 and 12, when the conductor rod was inserted by a depth of 4.5 mm, the resonant frequency decreased by about 2.5% or more. In this state, the deterioration in the unloaded Q value of the resonator was about 14% or less, which was a level practically acceptable.

In this embodiment, the position at which the conductor rod 44 is inserted may be more or less deviated from the center axis of the dielectric 40. However, the conductor rod 44 is desirably positioned on the center axis, because the electric field intensity in the $TM_{010}$ mode is highest on the center axis and thus the frequency can be changed with the highest sensitivity when the conductor rod 44 is located on the center axis. The depth of the hole 43 formed at the dielectric 40 for insertion of the conductor rod 44 is preferably in the range of about 6 mm to about 10 mm.

Thus, with the resonant frequency adjusting mechanism according to the present invention, the resonant frequency in the $TM_{010}$ mode can be widely adjusted without significant deterioration in unloaded Q value, enabling implementation of a filter using a resonator in this mode.

In this embodiment, the $TM_{010}$ mode resonator was described. The present invention is also applicable to TM mode resonators other than the $TM_{010}$ mode resonator, resonators in a hybrid wave resonant mode, and TE mode resonators. In these cases, also, substantially the same effects as those obtained in this embodiment can be obtained.

Embodiment 6

Figure 12A:
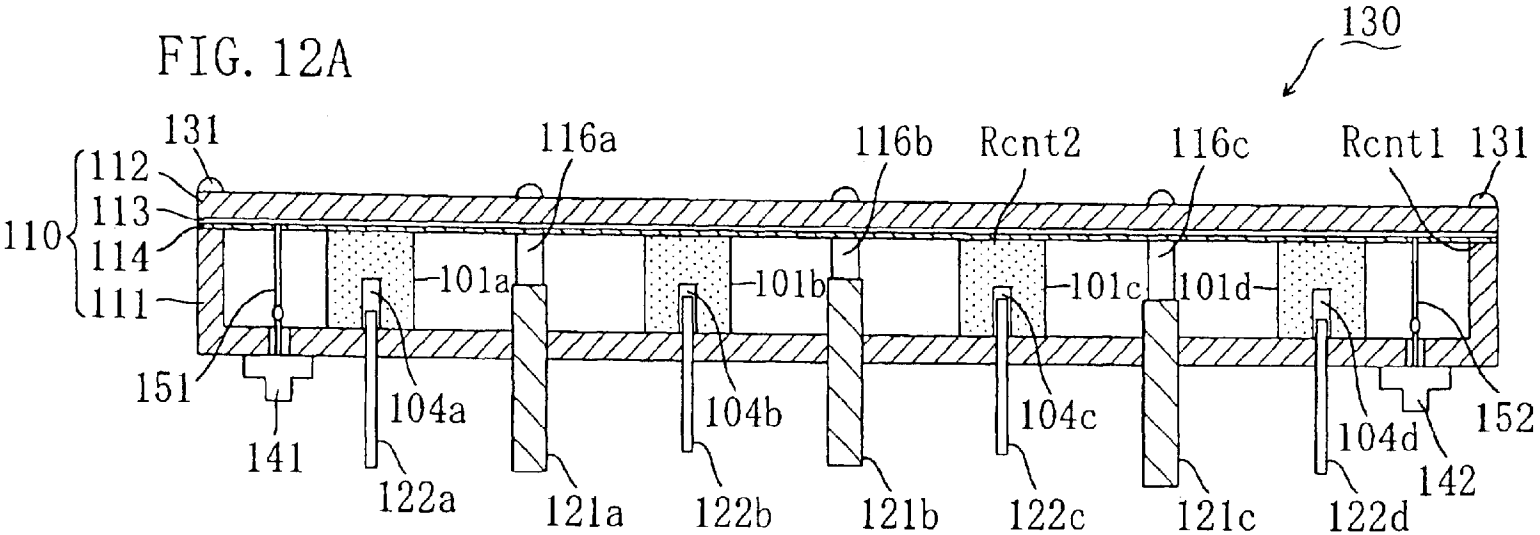
FIG. 12A is a cross-sectional view of a radio frequency filter using TM mode resonators of EMBODIMENT 6 of the present invention.
Figure 12B:
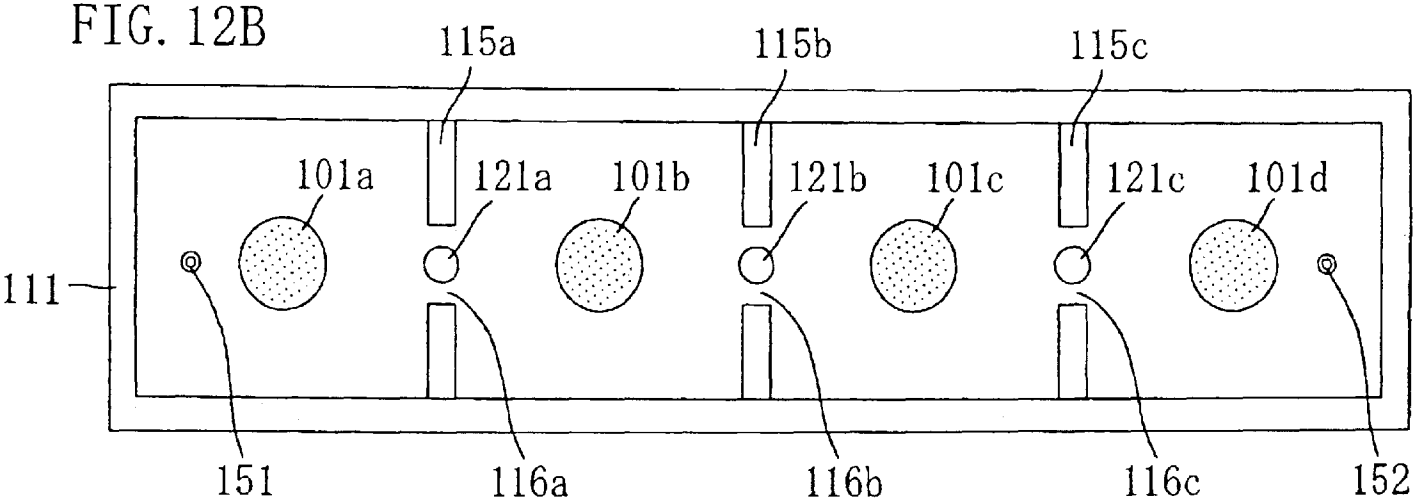
FIG. 12B is a plan view of the radio frequency filter from which a lid and the like have been removed.

FIG. 12A is a cross-sectional view of a radio frequency filter 130 using TM mode resonators of EMBODIMENT 6 of the present invention, and FIG. 12B is a plan view of the radio frequency filter 130 from which a lid and the like have been removed. The radio frequency filter 130 of this embodiment includes four cylindrical dielectrics 111*a* to 11*d* to serve as a 4-stage band-pass filter. The radio frequency filter 130 also includes a case 110 that is essentially constructed of a case body 111, a lid 112, a cushion layer 113, conductive foil 114, and partitions 115*a* to 115*c*. The case body 111 is composed of sidewalls and a bottom portion. The partitions 115*a* to 115*c*, which are respectively coupled with each other, divide the space defined by the case body 111 into chambers. Each of the dielectrics 101*a* to 101*d* is placed in each of the chambers separated by the partitions 115*a* to 115*c* in the case 110. That is, in the respective chambers of the case 110, the dielectrics 101*a* to 101*d* are electromagnetically shielded with the sidewalls and the bottom portion of the case body 111, the partitions 115*a* to 115*c*, and the conductive foil 114. Thus, the dielectrics 101*a* to 101*d*, the sidewalls and the bottom portion of the case body 111, the partitions 115*a* to 115*c*, and the conductive foil 114 constitute the resonator at four stages. The case body 111, the lid 112, the cushion layer 113, and the conductive foil 114 are secured to each other by being tightened with mounting bolts 131 at ten positions corresponding to the corners of the chambers. More specifically, by fastening the mounting bolts 131, the cushion layer 113 is deformed at the portions thereof corresponding to connections Rcnt1 between the sidewalls of the case body 111 and the lid 112 and between the partitions and the lid 112, to permit the sidewalls of the case body 111 and the partitions to come into close contact with the conductive foil 114. At the same time, the cushion layer 113 is also deformed at the portions thereof corresponding to connections Rcnt2 between the conductive foil 114 and the dielectrics 101*a* to 101*d*, to permit the dielectrics 101*a* to 101*d* to come into close contact with the conductive foil 114. As a result, as in EMBODIMENT 3, obtained is a filter free from a change in frequency due to vibration and stable over time.

In the manufacture of the radio frequency filter, fine adjustment is required for the resonant frequencies of the resonators and the degree of inter-stage coupling between adjacent resonators. For this purpose, in this embodiment, inter-stage coupling windows 116*a* to 116*c* are formed at the respective partitions 115*a* to 115*c* for securing electromagnetic coupling between the resonators. That is, coupling between the resonators is attained by estimating the degree of inter-stage coupling required for desired filter characteristics and then forming the coupling windows 116*a* to 116*c* having a width with which the estimated degree of inter-stage coupling is obtained. In addition, inter-stage coupling degree adjusting bolts 121*a* to 121*c* are provided for the respective inter-stage coupling windows 116*a* to 116*c* in the center thereof for adjusting the intensity of the electromagnetic coupling between the resonators.

An input coaxial connector 141 and an output coaxial connector 142 are provided for input/output of a radio frequency signal from/to outside at the bottoms of the two outermost chambers among the four chambers in the case body 111. An input coupling probe 151 and an output coupling probe 152 are connected to center conductors of the input coaxial connector 141 and the output coaxial connector 142, respectively, and extend from the bottom portion of the case body 111 to come into contact with the conductive foil 114. The input coupling probe 151 is provided to couple the input coaxial connector 141 with the input-stage dielectric 101*a* electromagnetically, while the output coupling probe 152 is provided to couple the output coaxial connector 142 with the output-stage dielectric 101*d* electromagnetically.

Conductor rods 122*a* to 122*d* made of a copper bolt have been inserted into holes 104*a* to 104*d* formed at the center of the bottoms of the dielectrics 101*a* to 101*d*. The conductor rods 122*a* to 122*d* function as the resonant frequency adjusting mechanism for the respective resonators.

Thus, in this embodiment, in which a plurality of resonators are arranged to constitute a multi-stage radio frequency filter, it is possible to realize an inter-stage coupling degree adjusting mechanism that is simple and wide in the range within which the degree of coupling is adjustable.

In this embodiment, the $TM_{010}$ mode resonator was described. The present invention is also applicable to TM mode resonators other than the $TM_{010}$ mode resonator, resonators in a hybrid wave resonant mode, and TE mode resonators. In these cases, also, substantially the same effects as those described in this embodiment can be obtained.

The number of resonators in the radio frequency filter of the present invention is not limited to four as in this embodiment, but may be any number as long as at least two resonators, an input-stage resonator and an output-stage resonator, are provided. The plurality of resonators are not necessarily arranged in series, but may be arranged in a matrix having a plurality of resonators in rows and columns as is viewed from above.

EXAMPLE

In this example, described is an example of design of a Chebyshev radio frequency filter having a center frequency of 2.14 GHz, a fractional bandwidth of 1%, and an in-band ripple of 0.05 dB.

As the dielectrics 101*a* to 101*d*, used was a dielectric ceramic material having a diameter of 9 mm, a length of 10 mm, a dielectric constant of 42, and a dielectric loss tangent (tan δ) of 0.00005. The case body 111 was made of oxygen-free copper having a thickness of 4 mm. As the conductive foil 114, copper foil having a thickness of 0.05 mm was used. As the cushion sheet 113, used was a flexible Teflon resin sheet having a thickness of 0.2 mm. The resonant frequency in the $TM_{010}$ mode of each resonator was determined so that the center frequency of the radio frequency filter of 2.14 GHz was obtained, and from this design, the inner dimensions of each resonator were calculated. As for the initial-stage resonator including the dielectric 101*a* and the final-stage resonator including the dielectric 101*d*, the inner dimensions of the chambers were set at 10 mm high×21 mm deep×24 mm long, in consideration of the effect that the resonant frequency slightly increases due to the existence of the input coupling probe 151 or the output coupling probe 152 compared with a resonator in a loose coupling state. As for the second-stage resonator including the dielectric 101*b* and the third-stage resonator including the dielectric 101*c*, the inner dimensions of the chambers were set at 10 mm high×21 mm deep×21 mm long.

The input coupling probe 151 and the output coupling probe 152, made of a silver-plated copper line having a diameter of 0.8 mm, were placed at positions apart by 8.5 mm from the center axes of the dielectrics 101*a* and 101*d*, respectively. The input and output coupling probes 151 and 152 should be soldered to the conductive foil 114. As the interstage coupling degree adjusting bolts 121*a* to 121*c*, M4 copper bolts were used.

The holes of the dielectrics 101*a* to 101*d* were designed to have a diameter of 2.4 mm and a depth of 8 mm. As the conductor rods 122*a* to 122*d*, M2 copper bolts were used.

The degree of input/output coupling was determined by adjusting the distances of the input and output coupling probes 151 and 152 from the center axes of the respective dielectrics 101*a* and 101*d*. Fine adjustment of the degree of coupling was performed by finely adjusting the distance of the center portion of the probe from the center axis of the dielectric using tweezers. The degree of inter-stage coupling was determined by adjusting the window width of the inter-stage coupling windows 116*a* to 116*c* using the inter-stage coupling degree adjusting bolts 121*a* to 121*c*.

Under the above conditions, the degree of input/output coupling of the radio frequency filter was about 100 in terms of the external Q value, the coupling coefficient between the initial and second stages and between the third and final stages was about 0.0084, and the coupling coefficient between the second and third stages was about 0.0065.

Figure 13:
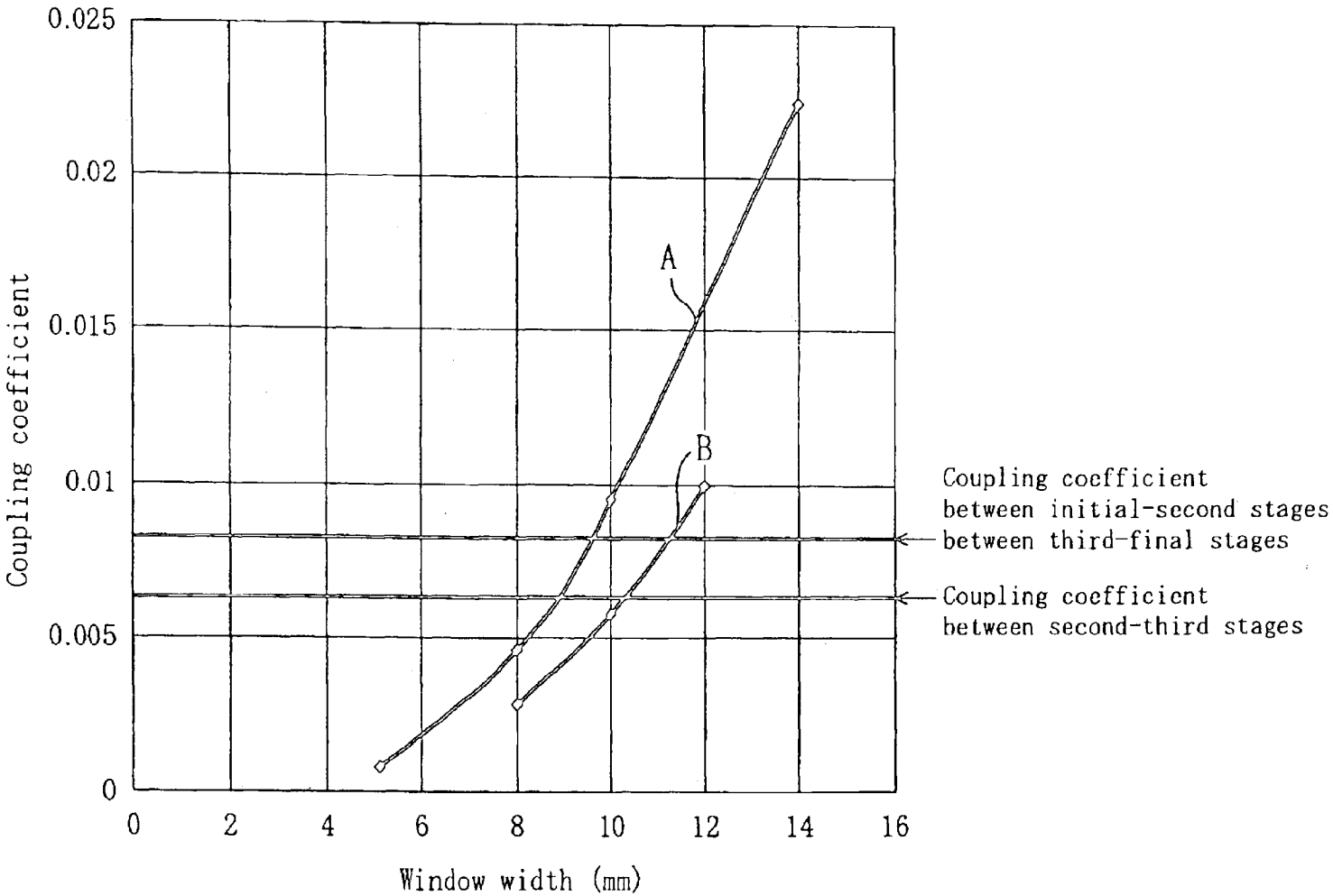
FIG. 13 is a view showing the results of simulation of the change in coupling coefficient with respect to the window width for inter-stage coupling windows.

FIG. 13 shows the results of simulation of the change in coupling coefficient with respect to the window width for the inter-stage coupling windows 116*a* to 116*c*, performed for determination of the coupling coefficient.

Figure 14A:
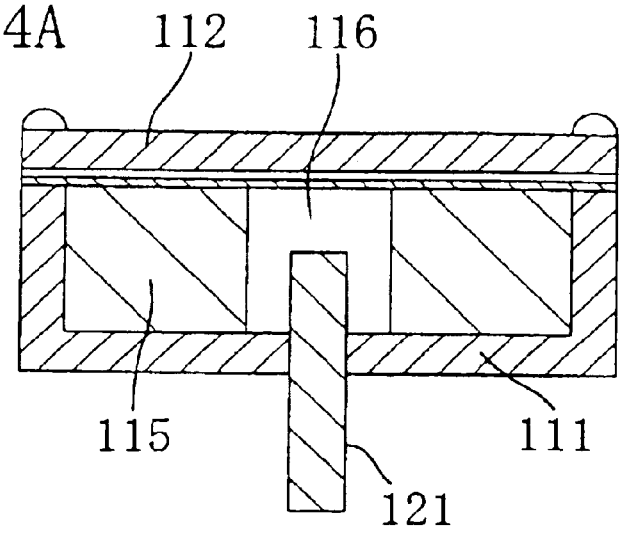
FIGS. 14A through 14C are cross-sectional views illustrating variations of the shape of the inter-stage coupling window and the position at which an inter-stage coupling degree adjusting bolt is mounted, which are adoptable in EMBODIMENT 5 of the present invention.
Figure 14B:
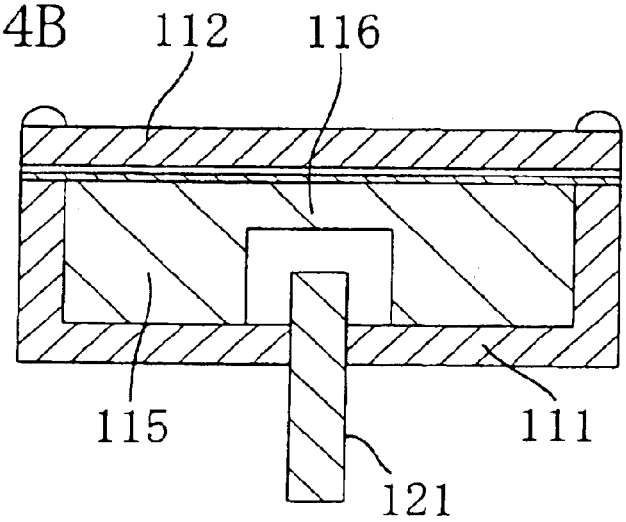
Figure 14C:
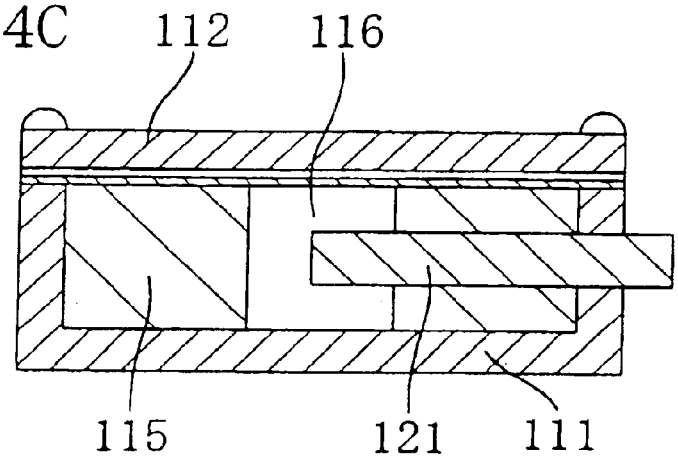

FIGS. 14A to 14C are cross-sectional views showing variations of the shape of the inter-stage coupling window and the position at which the inter-stage coupling degree adjusting bolt is mounted, which can be adopted in this embodiment. In the structure shown in FIG. 14A, the inter-stage coupling window 116 is formed vertically through the center of the partition 115, and the inter-stage coupling degree adjusting bolt 121 is mounted at the bottom portion of the case body 111 and extends vertically. In the structure shown in FIG. 14B, the inter-stage coupling window 116 is formed in the center and lower part of the partition 115, and the inter-stage coupling degree adjusting bolt 121 is mounted at the bottom portion of the case body 111. In the structure shown in FIG. 14C, the inter-stage coupling window 116 is formed vertically through the center of the partition 115, and the inter-stage coupling degree adjusting bolt 121 is mounted at the sidewall of the case body 111 and extends laterally. In this embodiment including the example, the structure shown in FIG. 14A that provides a large coupling coefficient was adopted.

Figure 15:
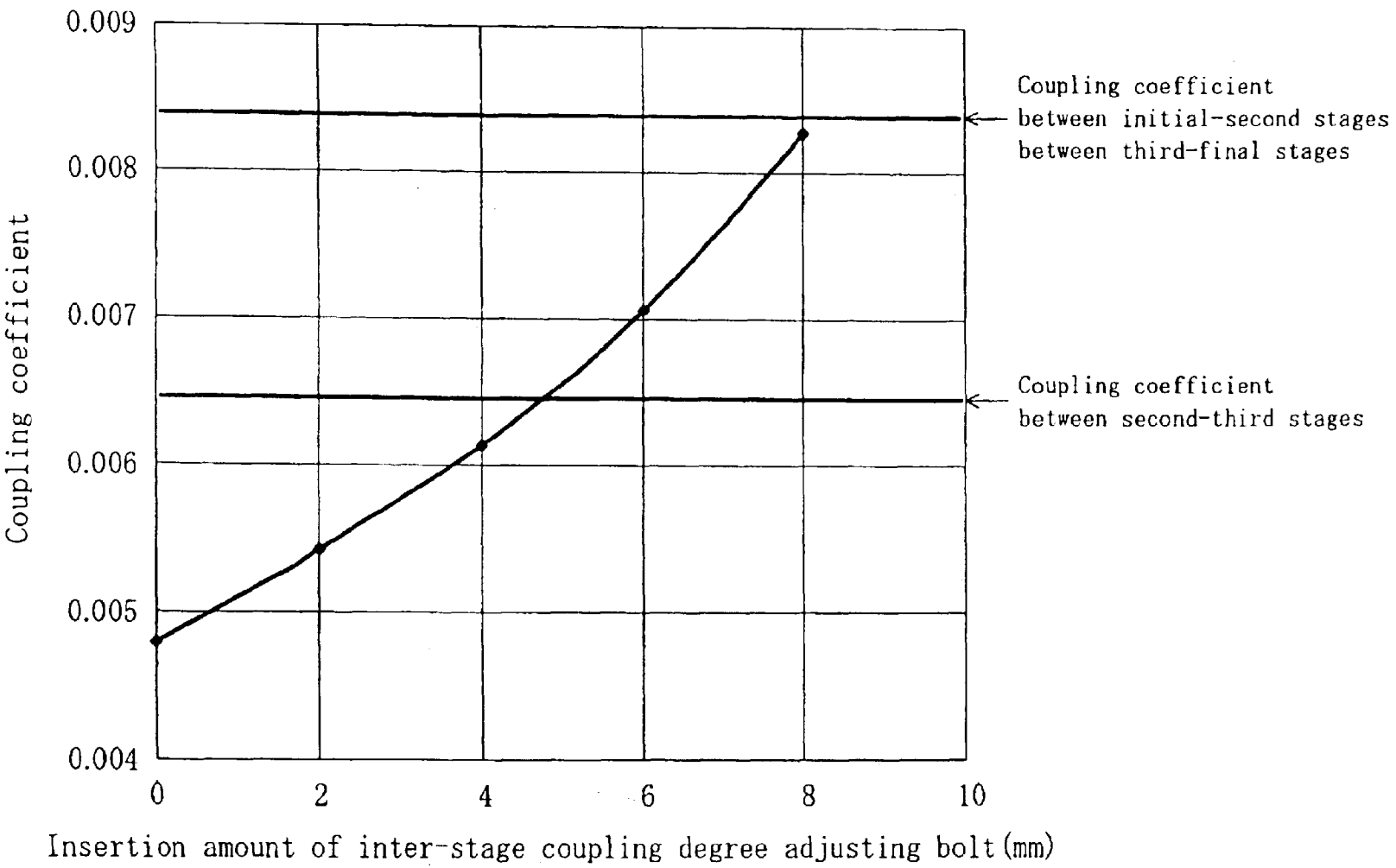
FIG. 15 is a view showing the results of simulation of the change in coupling coefficient with respect to the amount of insertion of the inter-stage coupling degree adjusting bolt into the inter-stage coupling window.

FIG. 15 is a view showing the results of simulation of the change in coupling coefficient with respect to the amount of insertion of the inter-stage coupling degree adjusting bolt 121 into the inter-stage coupling window 116. The difference in the change amount of the degree of coupling per unit insertion amount was small between the lateral insertion of the inter-stage coupling degree adjusting bolt as shown in FIG. 14C and the vertical insertion of the inter-stage coupling degree adjusting bolt as shown in FIGS. 14A and 14B. It was also found that as the diameter of the inter-stage coupling degree adjusting bolt 121 was greater, the change amount of the degree of coupling per unit insertion amount was greater. In this embodiment, the diameter was set at 4 mm, the same size as the thickness of the partition 115. The inter-stage coupling degree adjusting bolt 121 having this diameter can provide a largest change amount of the degree of coupling under the condition that the Q value of the resonator is not adversely affected.

Figure 16:
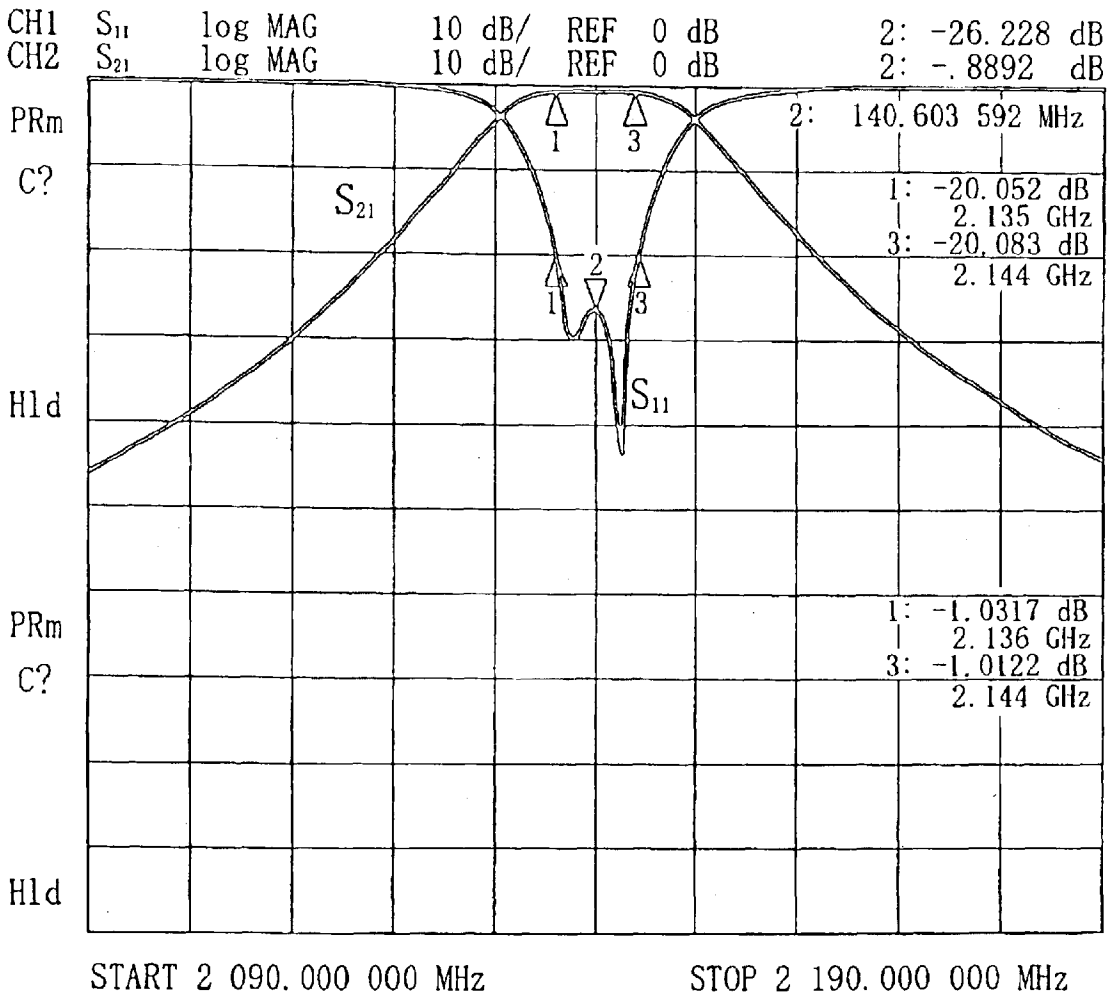
FIG. 16 is a characteristic view of a radio frequency filter including resonators at four stages designed.

FIG. 16 is a characteristic view of the radio frequency filter including four resonators designed based on the above design. As is found from FIG. 16, obtained is a radio frequency filter having good characteristics such as a fractional bandwidth in a passing region of 1%, an insertion loss of 0.9 dB, and a return loss of 20 dB or more, permitting use for cellular phone base stations, for example.

Embodiment 7

Figure 17:
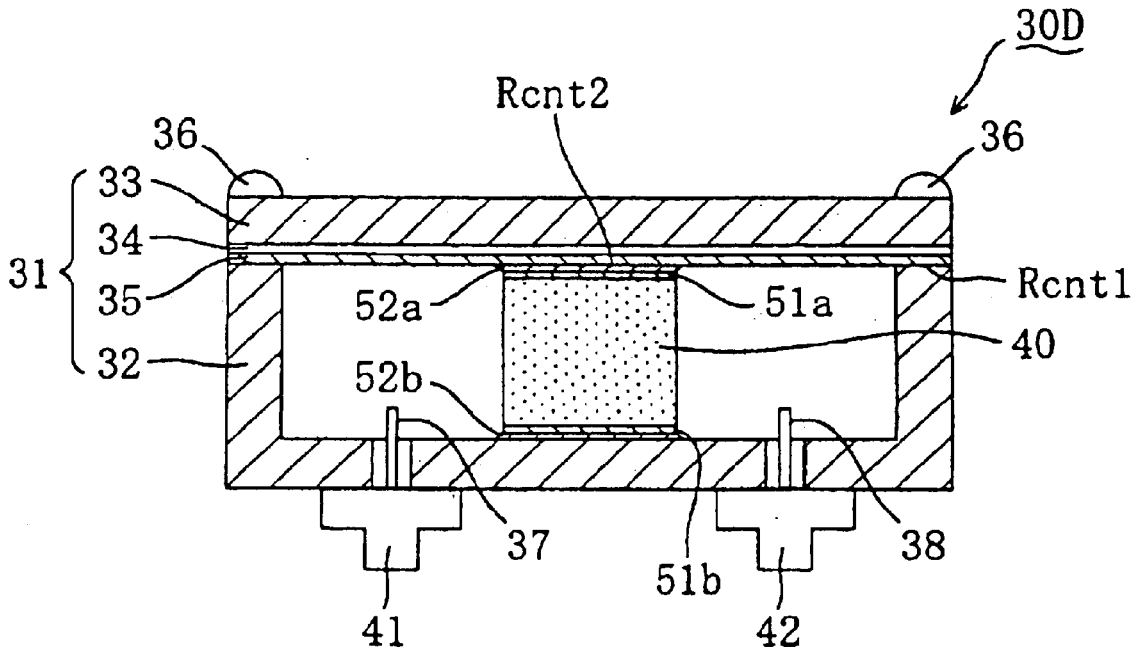
FIG. 17 is a cross-sectional view of a radio frequency filter using a TM mode resonator of EMBODIMENT 7 of the present invention.

In EMBODIMENTS 3 through 6, the dielectric and the conductive foil were in direct contact with each other. Alternatively, a conductor layer may additionally be formed between the dielectric and the conductive foil. FIG. 17 is a cross-sectional view of a radio frequency filter 30D using a TM mode resonator of EMBODIMENT 7 of the present invention. As shown in FIG. 17, the radio frequency filter 30D has basically the same construction as that of the radio frequency filter 30A of EMBODIMENT 3 shown in FIG. 7. The feature of the radio frequency filter 30D of this embodiment is that metallized layers 51*a* and 51*b* are formed on the top and bottom surfaces of the dielectric 40, respectively. The metallized layer 51*a* and the conductive foil 35 are electrically and mechanically connected with each other with solder 52*a*, while the metallized layer 51*b* and the bottom portion of is the case body 32 are electrically and mechanically connected with each other with solder 52*b*.

The structures and the functions of the other components of the radio frequency filter 30D of this embodiment are substantially the same as those in EMBODIMENT 3. Therefore, these components shown in FIG. 17 are denoted by the same reference numerals as those in FIG. 7, and the description thereof is omitted here.

Thus, in this embodiment, it is possible to reliably avoid the possibility of generation of a gap between the dielectric 40 and the conductive foil 35 due to vibration and the like.

In this embodiment, the $TM_{010}$ mode resonator was described. The present invention is also applicable to TM mode resonators other than the $TM_{010}$ mode resonator and resonators in a hybrid wave resonant mode. In these cases, also, substantially the same effects as those obtained in this embodiment can be obtained.

EXAMPLE

As the metallized layers 51*a* and 51*b*, (1) Ag metallized layers having a typical thickness of 5 to 30 $\mu$m formed by dipping in Ag paste and heating, (2) Ag plated layers having the same thickness, or (3) Ag evaporated layers having a typical thickness of 1 to 5 $\mu$m were used. Cream solder good in workability and adhesion was used for the soldering. The other components were the same as those in the example of EMBODIMENT 3.

The resultant resonator in this example decreased in unloaded Q value by about 15% to about 20% compared with the case of direct contact between the conductive foil 35 and the dielectric 40 as in EMBODIMENT 3, but exhibited reduction in deterioration of the characteristics with the temperature change, and in particular, was excellent in stability.

Embodiment 8

In EMBODIMENTS 4 and 6, the input coupling probe and the output coupling probe were connected to the conductive foil. According to the present invention, the input and output coupling probes are not necessarily connected to the conductive foil.

Figure 18:
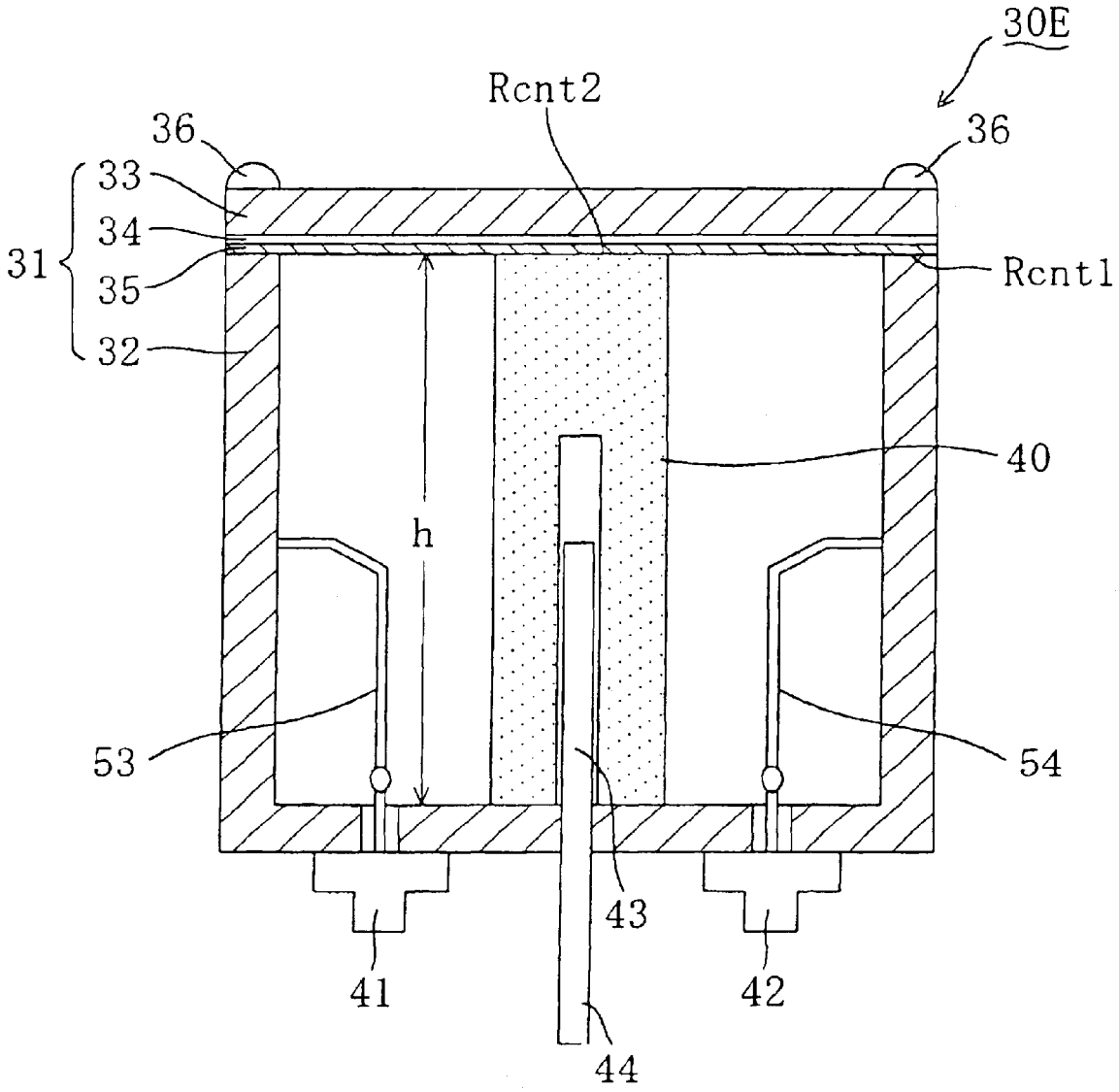
FIG. 18 is a cross-sectional view of a radio frequency filter using a TM mode resonator of EMBODIMENT 8 of the present invention.
Figure 19A:
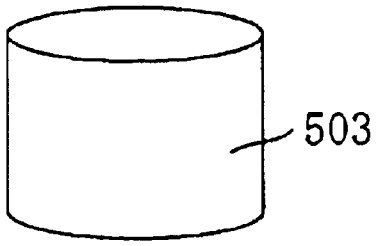
PRIOR ART FIG. 19A
FIGS. 19A and 19B are a perspective view and a cross-sectional view, respectively, of a conventional dielectric resonator using a $TE_{01\delta}$ mode as the base mode.
Figure 19B:
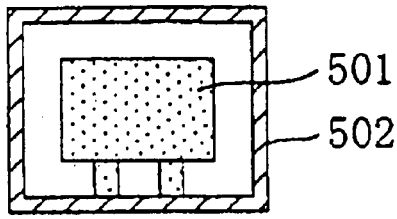
PRIOR ART FIG. 19B

FIG. 18 is a cross-sectional view of a radio frequency filter 30E using a TM mode resonator of EMBODIMENT 8 of the present invention. The radio frequency filter 30E has basically the same construction as the radio frequency filter 30C of EMBODIMENT 5 shown in FIG. 9.

The feature of the radio frequency filter 30E of this embodiment is that an input coupling probe 53 and an output coupling probe 54 extend vertically from the bottom portion of the case body 32 and then curve midway to be in contact with the sidewall of the case body 32.

The structures and the functions of the other components of the radio frequency filter 30E of this embodiment are substantially the same as those in EMBODIMENT 5. Therefore, these components shown in FIG. 18 are denoted by the same reference numerals as those in FIG. 9, and the description thereof is omitted here.

The structure of the input coupling probe 53 and the output coupling probe 54 of this embodiment is suitable for the case that the height h of the inner wall of the case body 32 is large and a comparatively large length of the probe can be secured even when the probe is curved midway. Thus, in this embodiment, where the input coupling probe 53 and the output coupling probe 54 are made in conduction with the sidewall of the case body 32, it was possible to obtain input/output coupling sufficiently large to secure a certain degree of fractional bandwidth.

In this embodiment, the $TM_{010}$ mode resonator was described. The present invention is also applicable to TM mode resonators other than the $TM_{010}$ mode resonator, resonators in a hybrid wave resonant mode, and TE mode resonators. In these cases, also, substantially the same effects as those described in this embodiment can be obtained.

(Modifications to Embodiments 3 to 8)

The cushion layer may be made of a material other than that described in EMBODIMENTS 3 through 8. For example, substantially the same effects can be obtained by using: elastic polymer compounds such as silicone rubber and natural rubber; polymer compounds having plastic deformation such as polyethylene, polytetrafluoroethylene, and polyvinylidene chloride; and soft metals such as indium and solder. In either case, the thickness of the cushion layer is preferably in the range of 0.05 mm to 0.3 mm.

The number of resonators in the radio frequency filter of the present invention is not limited to four as in EMBODIMENT 6, but may be any number as long as at least two resonators, an input-stage resonator and an output-stage resonator, are provided. The plurality of resonators are not necessarily arranged in series, but may be arranged in a matrix having a plurality of resonators in rows and columns as is viewed from above.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A resonator comprising:

a columnar shielding case composed of a conductive material and defining an interior space; and a dielectric made of a dielectric ceramic material substantially filling the entire interior space, the resonator using a resonant mode causing generation of a current crossing a corner of the columnar shielding case;

wherein the resonator using a TM mode, wherein the dielectric includes a center portion and an outer portion covering at least part of the center portion, and the dielectric constant of the center portion is higher than the dielectric constant of the outer portion.

2. The resonator of claim 1, wherein the resonant mode is a TM mode.

3. The resonator of claim 1, wherein the columnar shielding case is in a shape of a cylinder or a square pole.

4. The resonator of claim 1, wherein the shielding case is a metallized layer formed on the surface of the dielectric.

5. A radio frequency filter having a columnar resonator using a resonant mode causing generation of a current crossing a corner, the resonator comprising:

a dielectric made of a dielectric ceramic material having top and bottom surfaces and at least one side surface; and a shielding conductor surrounding the dielectric formed in direct contact with the top, bottom and side surface of the dielectric;

wherein the resonator using a TM mode, wherein the dielectric includes a center portion and an outer portion covering at least part of the center portion, and the dielectric constant of the center portion is higher than the dielectric constant of the outer portion.

6. A radio frequency filter having a resonator, the resonator comprising:

a dielectric having a hole;

a case surrounding the dielectric;

an elastic layer sandwiched between the lid and the case body;

a planar conductive foil sheet sandwiched between the elastic layer and the case body;

the dielectric having lower and upper ends that are respectively disposed in contact with an inner face of the case and the conductive foil sheet; and a conductor rod inserted into the hole of the dielectric, the insertion depth of the conductor rod being variable, wherein a resonant frequency is adjusted with the insertion depth of the conductor rod into the hole.

7. A radio frequency filter having a plurality of resonators at least including an input-stage resonator having a dielectric and receiving a radio frequency signal from an external device and an output-stage resonator having a dielectric and outputting a radio frequency signal to an external device, the radio frequency filter comprising:

a case surrounding the plurality of resonators for electromagnetically shielding the respective resonators;

wherein each of the input-stage resonator and the output-stage resonator comprise:

(a) a case body and a lid;

(b) a dielectric fixed therein;

(c) an elastic layer which is sandwiched between the lid and the case body; and (d) a planar conductive foil sheet which is sandwiched between the elastic layer and the case body;

(e) wherein lower and upper ends of the dielectric are respectively fixed to an inner face of the bottom of the case body and the conductive foil in contact therewith, a partition formed between resonators of which electromagnetic fields are coupled with each other among the plurality of resonators;

an input-stage coupling window formed at the partition; and an input-stage coupling degree adjusting member made of a conductor rod for adjusting the area of the inter-stage coupling window.

* * * * *